US006336014B1

(12) United States Patent
Sato et al.

(10) Patent No.: US 6,336,014 B1
(45) Date of Patent: Jan. 1, 2002

(54) IMAGE DEVELOPING DEVICE WITH SEALING MEMBERS FOR PREVENTING TONER LEAKAGE

(75) Inventors: Fumikazu Sato, Inuyama; Hideaki Deguchi; Naoya Kamimura, both of Nagoya; Mitsuru Horinoe, Aichi-ken, all of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/597,276

(22) Filed: Jun. 19, 2000

(30) Foreign Application Priority Data

Jun. 18, 1999 (JP) ..... 11-172451
Jul. 8, 1999 (JP) ..... 11-194624
Sep. 24, 1999 (JP) ..... 11-270041

(51) Int. Cl.[7] ..... G03G 15/08
(52) U.S. Cl. ..... 399/103; 399/105
(58) Field of Search ..... 399/103, 105, 399/274, 284

(56) References Cited

U.S. PATENT DOCUMENTS 5,134,960 A * 8/1992 Shirai ..... 399/105
5,701,558 A * 12/1997 Kojima ..... 399/105

* cited by examiner

*Primary Examiner*—Arthur T. Grimley
*Assistant Examiner*—Hoang Ngo
(74) *Attorney, Agent, or Firm*—Oliff & Berridge PLC

(57) ABSTRACT

A layer thickness regulating blade 64 has a plate spring 64*b* and a pressing number 64*a* fixed thereto. The plate spring 64*b* is formed longer than the pressing member 64*a* so that both ends of the plate spring 64*b* are exposed. A front surface resilient foam seal 112 made from sponge is attached to the exposed portions, in contact with sides of the pressing member 64*a*. Further, a Teflon™ film 113 is attached on the plate spring 64*b* so as to cover the front surface resilient foam seal 112. A sponge side seal 111 is adhered to the rear surface of the plate spring 64*b*. A sponge side seal 107 is adhered to the developing case 51 at a position that confronts the blade side seal 111. An end seal 106 is adhered across a step portion E of the developing case 51 and the upper end of the base seal 104, and can compressing deform with the blade side seal 111 and the upper side seal 107.

24 Claims, 16 Drawing Sheets

IMAGE DEVELOPING DEVICE WITH SEALING MEMBERS FOR PREVENTING TONER LEAKAGE

BACKGROUND OF THE INVENTION

1. Field of the Invention

The present invention relates to a developing unit, a process cartridge, and a developing cartridge for developing images using developing agent.

2. Description of Related Art

A conventional image forming device includes a known developing unit that develops electrostatic latent images into visible images using charged particles of toner. This type of developing unit can leak toner. The leaked toner can stain the interior of the image forming device and recording sheets, thereby degrading printing quality. The leaked toner can also stain the user's hands or clothes during replacement of the developing unit.

One such developing unit with this problem includes a developing roller and a layer thickness regulating blade. The developing roller transports toner on its surface, and the layer thickness regulating blade regulates the toner on the surface of the developing roller to a thin layer. The layer thickness regulating blade includes a stainless steel plate spring and a rosin or rubber pressing member, both formed to the same length in their lengthwise direction. Non magnetic single component developing agent is used as toner. The toner easily leaks from around the edges of the developing roller as the developing roller rotates.

Conventionally, various configurations have been provided inside the developing unit in order to prevent toner leakage. As will be described next, side seals, a lower film and sponge seal members are examples of configuration provided for preventing toner leakage.

The side seals are formed from a urethane sponge with a Teflon™ felt attached thereto. The urethane sponge needs to be sufficiently soft and have a low compression set. The side seals are positioned on opposite sides of the layer thickness regulating blade, near one or the other end of the developing roller. The side seals are disposed in sliding frictional contact with the peripheral surface of the developing roller to prevent toner from leaking around the lengthwise ends of the developing roller. The Teflon™ felt can be pressed with sufficient pressing force against the developing roller, without increasing rotational torque required for rotating the developing roller. The sides seals also pressingly contact the layer thickness regulating blade so as to pressingly sandwich the blade therebetween, in order to prevent toner from leaking out between the layer thickness regulating blade and the side seals.

The side seals of one type of developing unit are provided with their side surfaces pressed against the pressing member of the layer thickness regulating blade. However, with this configuration, toner can easily leak from between the layer thickness regulating blade and the side seals.

The side seals of another type of developing unit are disposed with one edge in contact with the free edge of the layer thickness regulating blade. That is, assuming that the layer thickness regulating blade extends downward and the pressing member is at the lowermost end of the blade, then the upper edge of the side seals presses against the lower edge of the pressing member. With this configuration, toner can be prevented from leaking initially. However, over a long period of use, fiber from the Teflon™ felt of the side seals can press up the pressing member and enter between the layer thickness regulating blade and the developing roller. As a result, a gap can open between the pressing member and the developing roller. Toner can leak out through the gap.

Either of these configurations involves a trade off between toner leaks and sufficient pressing force between the side seals and the layer thickness regulating blade. That is, if the side seals press against the pressing member with a force sufficient for preventing toner from leaking, then the side seals can interfere with the function of the layer thickness regulating blade. The pressing force from the side can prevent the thickness regulating blade from uniformly pressing against the developing roller, especially at the end portions of the developing roller. As a result, the layer thickness regulating blade cannot provide a uniform-thickness toner layer on the developing roller. However, when the pressing force blade is reduced to prevent such interference, toner can leak from between the side seal and the layer thickness regulating blade.

The lower film is for preventing toner from leaking between the developing roller and the portion of the developing unit casing below the developing roller. The lower film is maintained in sliding frictional contact with the developing roller at this location. The lower film is usually made from urethane rubber or a polyethylene terephthalate (PET) sheet. Although the urethane rubber provides a sufficiently soft pressing force, it has insufficiently low stiffness on its own, and so needs to be pressed from behind by a sponge or other member. The PET sheet is stiffer than the urethane rubber film and so does not need to be pressed from behind by a sponge member. Therefore, the PET sheet makes assembly processes easier than does the urethane rubber film.

The sponge seal members are also for preventing toner leaks from between the thickness regulating blade and the developing unit casing. The sponge seal members are disposed near lengthwise ends of the layer thickness regulating blade, between the developing unit casing and the rear surface of the layer thickness regulating blade, that is, the surface of the layer thickness regulating blade that faces away from the developing roller. One surface of each sponge seal member is attached to either the layer thickness regulating blade or the developing unit casing by two-sided tape. The opposite surface of the sponge seal member is pressed against the other of the layer thickness regulating blade and the developing unit casing by pressure alone.

The thickness regulating blade itself also functions to prevent toner leakage. Because the thickness regulating blade presses against the developing roller, it prevents toner from leaking between the developing roller and the opening in the developing unit casing.

However, the layer thickness regulating blade vibrates in association with rotation of the developing roller. This vibration is sufficient for producing gaps between the sponge seal member and either the layer thickness regulating blade or the developing unit casing, whichever in not adhered to the sponge seal member. Polymerized toner, which has excellent fluidity, can easily leak through those gaps.

Moreover, the toner can also leak through other sealed areas wherein a sponge seal member merely presses against surfaces of other configurations that vibrate in association with rotation of the developing roller.

SUMMARY OF THE INVENTION

It is an objective of the present invention to reliably prevent toner from leaking between side seals and the layer thickness regulating blade, while maintaining proper pressing force between the layer thickness regulating blade and a developing roller.

It is another objective of the present invention to reliably prevent toner from leaking between the developing unit casing and components that can potentially vibrate even slightly.

To achieve the above-described objectives, a developing device according to the present invention for developing a latent static-electric image into a visible image from developer, includes a developing case, a developer bearing body, a developer layer thickness regulator, and contact members.

The developing case is for holding developer, and is formed with an elongated opening.

The developer bearing body is disposed in the opening of the developing case, with lengthwise ends of the developer bearing body rotatably supported on the developing case.

The developer layer thickness regulator includes a pressing member and a plate spring member. The pressing member is formed from rubber or resin and extends in a lengthwise direction of the developer bearing body. The plate spring member supports the pressing member pressingly against an outer periphery of the developer bearing body to form a thin layer of developer on the developer bearing body. The plate spring member extends in the lengthwise direction of the developer bearing body to a longer length than the pressing member. Also, the pressing member is separated from the lengthwise ends of the plate spring member. Therefore, end portions of the plate spring member are left uncovered by the pressing member.

The contact members each slidingly contact a corresponding peripheral surface of the developer bearing body near a corresponding lengthwise end of the developer bearing body. Each contact member is attached to a corresponding one of the end portions of the plate spring member and extends to cover the corresponding end portion.

According to this aspect of the present invention, it is desirable that base seals be additionally provided. In this case, the base seals are attached to the developing case, each facing a corresponding peripheral surface of the developer bearing body near a corresponding lengthwise end of the developer bearing body. Each contact member further extends to a corresponding base seal and is attached to the corresponding base seal. It is desirable that base seals be formed from a resilient foam material.

According to this aspect of the present invention, it is desirable that resilient foam seals be additionally provided. In this case, each resilient foam seal is interposed between a corresponding end portion of the plate spring member and a corresponding contact portion. The contact portions are attached to the corresponding end portion of the plate spring member through a corresponding base seal. It is desirable that the pressing member contacts each resilient foam seal along a length of 4 mm or greater.

According to this aspect of the present invention, it is desirable that the pressing member be formed from silicon rubber.

According to this aspect of the present invention, it in desirable that the pressing member have conductivity.

According to this aspect of the present invention, it is desirable that the developer bearing body is a resilient roller having conductivity.

According to another aspect of the present invention, a developing device for developing a latent static-electric image into a visible image of developer, includes a developing case, a developer bearing body, a member, a case-side seal, and a member-side seal.

With this aspect of the prevent invention also, the developing case is for holding developer and the developing case is formed with an opening.

Also, the developer bearing body is supported in the opening at lengthwise ends by the developing case.

The member vibrates in association with rotation of the developer bearing body.

The case-side seal is made from a resilient foam material attached to the developing case.

The member-side seal is made from a resilient foam material attached to a surface of the member and in abutment with the case-side seal.

According to this aspect of the present invention, it is desirable that the member be an elongated developer layer thickness regulator disposed with a front surface thereof pressed against an outer periphery of the developer bearing body to form a thin layer of developer on the developer bearing body. The elongated developer layer thickness regulator has a rear surface facing opposite from the front surface. The member-side seal in attached near a lengthwise end of the developer layer thickness regulator on the rear surface of the developer layer thickness regulator.

The developing case can be formed with a seal attachment surface and a regulator attachment surface, wherein the developer layer thickness regulator is positioned on the regulator attachment surface to resiliently press the case-side seal and the member-side seal in a thickness direction of the case-side seal and the member-side seal. The seal attachment surface is receded from the regulator attachment surface in the thickness direction by a step portion that extends from the seal attachment surface and that is located adjacent to ends of the developer layer thickness regulator and the member-side seal. With this configuration, it is desirable that an end seal formed from a resilient foam member be attached to the step portion in contact with the end of the case-side seal. It is desirable that the case-side seal be attached to the developing case in pressing contact with the end seal, and that the end seal have a thickness in a non-compressed condition of 2 mm or less.

According to both of the above-described aspects, it is desirable that the developer be a polymerized toner formed by polymerization techniques.

According to both of the above-described aspects, it is desirable that a static electric latent image bearing member be provided, and that the developing case include a process cartridge case that houses the static electric latent image bearing member.

According to both of the above-described aspects, it is desirable that a process cartridge case be further provided. In this case, the developing case is adapted for free attachment and detachment with respect to the process cartridge case.

According to both of the above-described aspects, it is desirable that an image forming device be further provided. In this case, the developing case is adapted for free attachment and detachment with respect to the image forming device.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE EMBODIMENTS

A laser beam printer 1 including a developing unit according to an embodiment of the present invention will be described while referring to the accompanying drawings.

Figure 1:
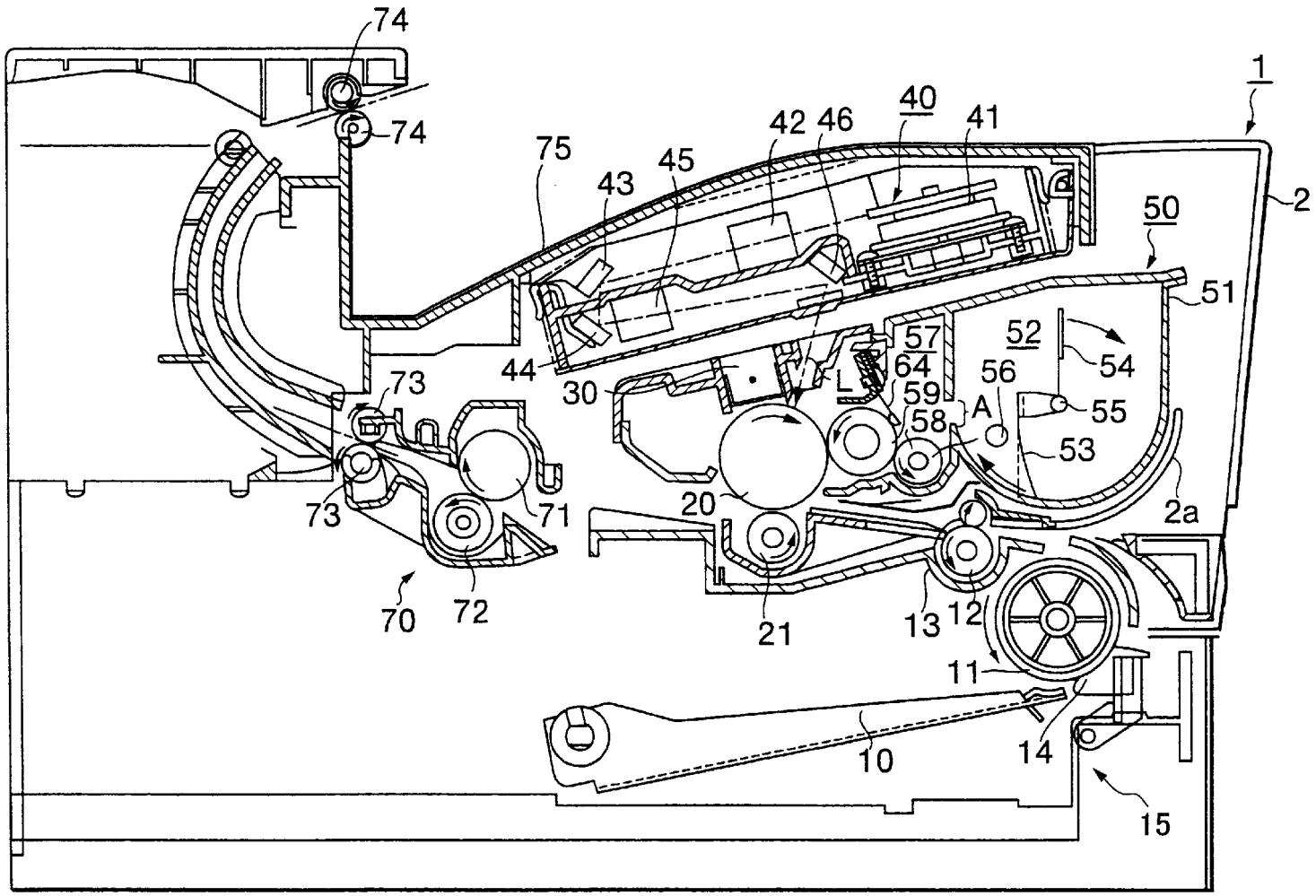
FIG. 1 is a cross-sectional view showing configuration of an image forming device according to the embodiment of the present invention.

As shown in FIG. 1, the laser beam printer 1 includes a case 2, a feeder unit 15 for supplying sheets (not shown) stored in a stack at the bottom portion of the case 2, a laser scanner unit 40, a developing unit 50, and various components aligned along a sheet transport pathway along which sheets are transported from the feeder unit 15 to be discharged from the pointer 1.

The feeder unit 15 includes a friction separation member 14, a sheet supply roller 11, and a sheet pressing plate 10. The sheet pressing plate 10 is pressed upward by a spring (not shown), and presses the sheets upward against the sheet supply roller 11. When the sheet supply roller 11 rotates in the direction indicated by an arrow in FIG. 1, the uppermost sheet of the stack in separated from between the sheet supply roller 11 and the friction separation member 14. One sheets at a time is supplied in the manner at a predetermined timing.

A pair of register rollers 12 and 13 are rotatably supported at a position downstream along the pathway which sheets are transported by rotation of the sheet supply roller 11. The pair of register rollers 12 and 13 perform a register operation at a predetermined timing to align the front edge of sheets from the feeder unit 15.

A transfer roller 21 and a photosensitive drum 20 are disposed along the sheet transport pathway, at a position downstream from the register rollers 12, 13. The transfer roller 21 and the photosensitive drum 20 define therebetween a transfer position where the register rollers 12, 13 transport sheets after registration operations.

The photosensitive drum 20 is rotatably supported on the case 2, and driven by a drive means (not shown) to rotate in a direction indicated by an arrow in FIG. 1. The photosensitive drum 20 is configured from a hollow drum with an aluminum cylindrical sleeve as its main body. An organic photoconductive layer is formed on the outer peripheral surface of the cylindrical sleeve to a predetermined thickness of, for example, about 20 μm. The photoconductive layer is formed from positively-charging polycarbonate as its main component. A photoconductive resin is dispersed in the polycarbonate. The photosensitive drum 20 can have other configurations that provide it with a positively charging nature.

The transfer roller 21 is configured from a resilient foam body having electrical conductivity. The resilient foam body is formed from silicon rubber or urethane rubber, for example, and is freely rotatably supported. The transfer roller 21 is applied with a voltage, so that the toner image on the photosensitive drum 20 is reliably transferred to a sheet transported between the photosensitive drum 20 and the transfer roller 21.

A charge unit 30 is disposed adjacent to the photosensitive drum 20. The charge unit 30 is configured from, for example, a positively charging scorotoron charge unit that generates a corona discharge from a charge wire, which is formed from tungsten for example.

The laser scanner unit 40 includes a laser generator (not shown), a polygon mirror (five-surfaced mirror) 41 that is driven to rotate, a pair of lenses 42 and 45, and reflection mirrors 43, 44, and 46. The laser generator generates a laser light L to form an eleotrostatic latent image on the photosensitive drum 20.

The developing unit 50 includes a developing case 31 formed with a toner holding chamber 52 and a developing chamber 57. A rotational shaft 55 is provided in the toner holding chamber 52. An agitator 53 for agitating the toner and transferring the toner into the developing chamber 57, and a cleaning member 54 are fixed on the shaft 55, and so rotate in association with rotation of the shaft 55. Also, light transmission windows 56 are provided in the inner walls of the toner holding chamber 52, one adjacent to each end of the rotational shaft 55.

The toner holding chamber 52 is filled with a non-magnetic single-component toner that has a positively charging nature and electrically insulating properties. The toner base particles have a particle diameter of between 6 microns and 10 microns, and an average particle diameter of 8 microns. The toner base particles are formed by adding a well-known coloring agent. such as carbon black, and a charge control agent, such as nigrosine, triphenylmethane, and quaternary ammonium salt, to styrene acryl resin that has been formed in spheres by suspension polymerization. The toner is configured by adding silica as an outer additive to the surface of the toner base particles.

The developing chamber 57 is formed nearer the photosensitive drum 20 than the toner holding chamber 52, and includes a portion for rotatably supporting a toner supply roller 58 and a developing roller 59. The toner supply roller 58 supplies toner from the toner holding chamber 52 to the developing roller 59. A layer thickness regulating blade 64 having a resilient thin shape is disposed in the developing chamber 57, for regulating toner supplied by the toner supply roller 58 to a predetermined thickness on the developing roller 59.

The developing roller 59 supplies the layer of toner to develop the electrostatic latent image formed on the photosensitive drum 20 by the laser scanner unit 40. The developing unit 59 includes a metal core formed from stainless steel and a cylindrical base member provided on the metal core. The base member is formed from a conductive silicon rubber including particles of conductive carbon. A coating is formed on top of the base member. The coating is formed from a resin or rubber that includes fluorine. It should be noted that the base member of the developing unit 59 can be formed from a conductive urethane rubber rather than from conductive silicon rubber.

A fixing unit 70 in provided along the sheet transport pathway, at a position further downstream from the photosensitive drum 20 and the transfer roller 21. The fixing unit 70 includes a heat roller 71 and a pressing roller 72. The heat roller 71 and the pressing roller 72 press and heat the toner image transferred from the photosensitive drum 20 onto a sheet, thereby fixing the toner image onto the sheet. A pair of transport rollers 73 and a pair of discharge rollers 74 for transporting the sheet are each provided along the sheet transport pathway further downstream from the pressing roller 72. A discharge tray 75 is provided downstream from the discharge rollers 74.

It should be noted that the transfer roller 21, the charge unit 30, the photosensitive drum 20, and the developing unit 50 are housed in a process cartridge case 2*a,* which is detachable from the laser beam printer 1. Further, the developing unit 50 is freely detachable from the process cartridge case 2*a,* and functions as a developing unit cartridge. The process cartridge case 2*a* could be considered a portion of the developing case 51.

Image formation operations that the laser beam printer 1 performs to form an image on a sheet will be described briefly here. The charge unit 30 uniformly charges the surface of the photosensitive drum 20. Then the laser scanner unit 40 emits laser light L as modulated according to image information, to form an electrostatic latent image on the surface of the photosensitive drum 20. The developing unit 50 develops the latent image into a visible image using toner. The photosensitive drum 20 rotates to transport the visible image toward the transfer position between the transfer roller 21 and the photosensitive drum 20. At this time, the sheet supply roller 11 and the register rollers 12 and 13 supply a sheet to the transfer position. The transfer roller 21 is applied with a transfer bias to transfer the visible toner image on the photosensitive drum 20 onto the sheet transported to the transfer position. It should be noted that any toner remaining on the photosensitive drum 20 after transfer is collected by the developing roller 59 and returned to the developing chamber 57.

Next, the sheet with the toner image is transported between the heat roller 71 and the pressing roller 72 of the fixing unit 70. The heat roller 71 and the pressing roller 72 press and heat the visible image on the sheet, and fix the image onto the sheet. The sheet is then discharged onto the discharge tray 75 by the pair of the transport rollers 73 and the pair of the discharge rollers 74. This completes image formation operations.

Figure 2A:
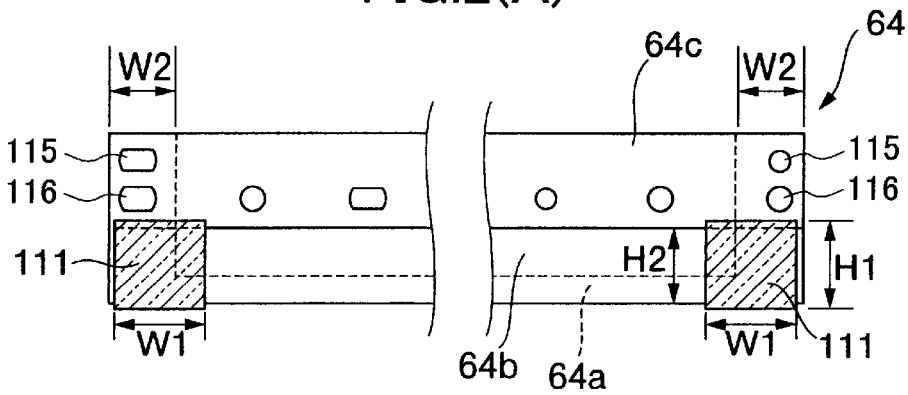
FIG. 2(A) is a plan view showing a rear surface of a layer thickness regulating blade of the image forming device of FIG. 1.

Next, configuration of the layer thickness regulating blade 64 will be described while referring to FIGS. 2(A) to 2(C). As mentioned previously, the layer thickness regulating blade 64 faces the developing roller 59. The surface of the layer thickness regulating blade 64 that faces the developing roller 59 will be referred to as the front surface, and the surface of the layer thickness regulating blade 64 that faces away from the developing roller 59 will be referred to as the rear surface, hereinafter.

The layer thickness regulating blade 64 includes a support portion 64*c*, a plate spring 64*b*, and a pressing member 64*a*. The layer thickness regulating blade 64 further includes front surface blade seals 112 and rear surface blade seals 111 for preventing toner from leaking around the ends of the layer thickness regulating blade 64.

The support portion 64*c* is formed from iron or stainless steel to a length L1 in directions X. The support portion 64*c* is formed near its edges with boss holes 115 and screw holes 116. The plate spring 64*b* is a thin plate formed from phosphor bronze or stainless steel, for example, and 18 attached to the support portion 64*c*. The plate spring 64*b* has the same length L1 in the direction X and a height H2 in a direction Y. The pressing member 64*a* is formed from a silicon rubber that has conductivity to a length L2 that is shorter than the length L1. Said differently, the plate spring 64*b* extends in the lengthwise direction of the developing roller to a longer length L1 than the length L2 of the pressing member 64*a*. The pressing member 64*a* is attached to the front surface of the plate spring 64*b*, centered along the direction X of the plate spring 64*b*, thereby leaving end portions of the plate spring 64*b* uncovered by the pressing member 64*a*. With this configuration, the plate spring 64*b* has exposed portions near its ends where the pressing member 64*a* is not provided. The exposed portions each have a width W2 in the direction L.

Both the rear surface blade seal 111 and the front surface resilient foam seal 112 are made from a sponge material that is softer then the urethane sponge. As shown in FIG. 2(A), one rear surface blade seal 111 is attached by two-sided tape near each end of the plate spring 64*b*, on the rear surface of the plate spring 64*b*. Each rear surface blade seal 111 has a width W1 in the directions X, which is wider than the width W2 of the exposed portions of the plate spring 64*b*. As a result, each rear surface blade seal 111 covers a region in the directions X on the rear surface of the plate spring 64*b*, that corresponds to one of the exposed regions on the front surface of the plate spring 64*b*. The rear surface blade seal 111 is formed in the direction Y to a height H1, which is greater than the height H2 of the plate spring 64*b*.

Figure 2B:
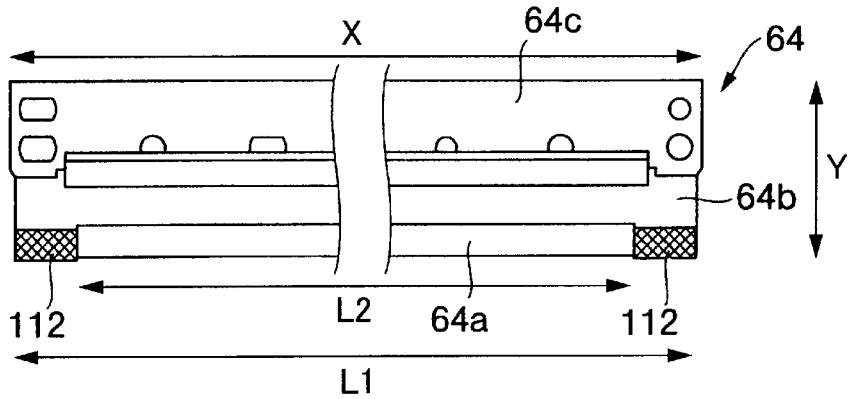
FIG. 2(B) is a plan view showing a front surface of the layer thickness regulating blade.
Figure 2C:
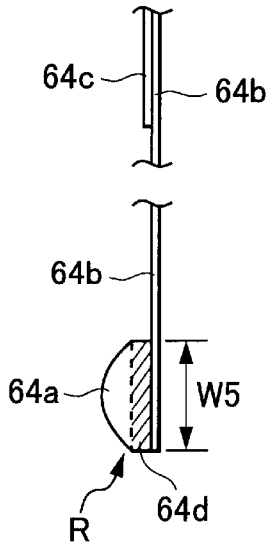
FIG. 2(C) is a cross-sectional view of the layer thickness regulating blade.

As shown in FIG. 2(B), one front surface resilient foam seal 112 is attached to each exposed portion of the plate spring 64*b* by two-sided tape, so that the pressing member 64*a* is sandwiched between the front surface blade seals 112. As shown in FIG. 3(C), the cross section of the pressing member 64*a* includes a curved surface R that contacts the developing roller 59, and a rectangular surface, or contact region, 64*d* that contacts the plate spring 64*b*. The contact region 64*d* is indicated by hatching in FIG. 2(C). The contact region 64*d* has a width W5 in the direction Y of 4 mm or greater. Because the contact region 64*d* is not adhered to the front surface resilient foam seal 112, the contact portion 64*d* rubs against the front surface resilient foam seal 112 in association with vibration of the plate spring 64*b*. However, because the contact region 64*d* contacts the front surface resilient foam seal 112 with sufficiently large surface area having the width W5 of 4 mm or greater, toner can be reliably prevented from leaking at this contact region 64*d* over a long period of time.

The inventor shortened the contact region 64*d* to less than the width W5 of 4 mm and performed experiments to test the effects of this change. The test results indicated that the contact region 64*d* with a width less that the width W5 of 4 mm was insufficient, and slight amounts of toner leakage were observed. It should be noted that the pressing member 64*a* can be formed in any shape, and is not limited to the shape shown in FIG. 2(C), as long as the pressing member 64*a* provides a contact region 64*d* with the sufficient width of W5.

Figure 3A:
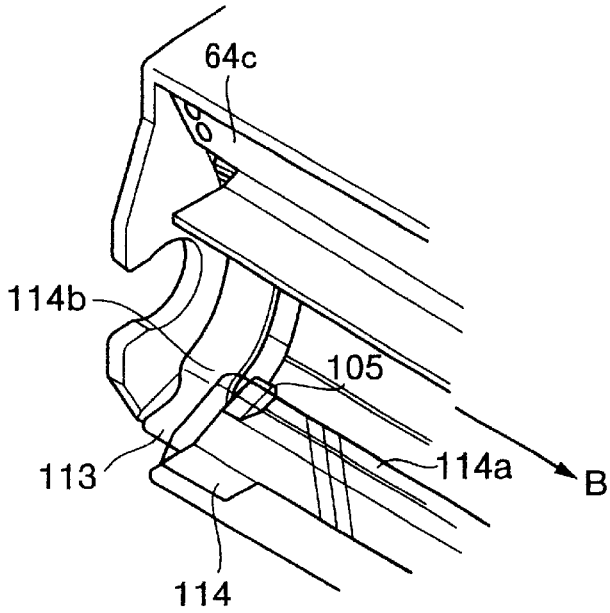
FIG. 3(A) is a partial cross-sectional view showing seal configuration at one lengthwise end of a developing unit case of the image forming device.
Figure 3B:
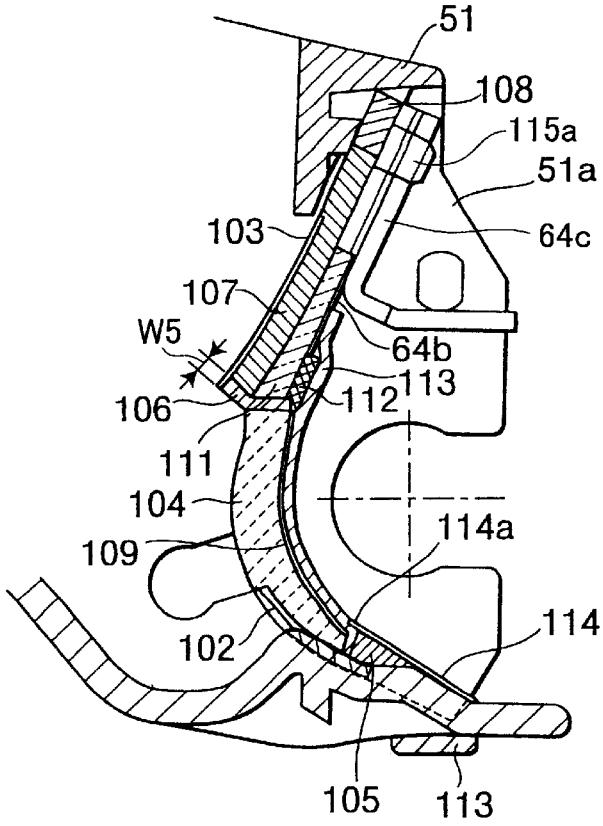
FIG. 3(B) is a cross-sectional view showing seal configuration at the opposite lengthwise end of the developing case as viewed from the direction indicated by arrow B in FIG. 3(A)

FIG. 3(B) shows the layer thickness regulating blade 64 attached to the developing case 51 by a boss 115*a* of the developing case 51 and a screw (not shown). The boss 115*a* passes through the boss hole 115 and the screw passes through the screw hole 116. When the developing roller 59 is mounted into the developing case 51, the pressing member 64*a* is pressed into contact with the outer surface of the developing roller 59 by resilient force of the pressing plate 64*a* and resilient force of the plate spring 64*b*. As a result, the toner layer on the developing roller 59 can be regulated to a desired thickness.

Figure 5A:
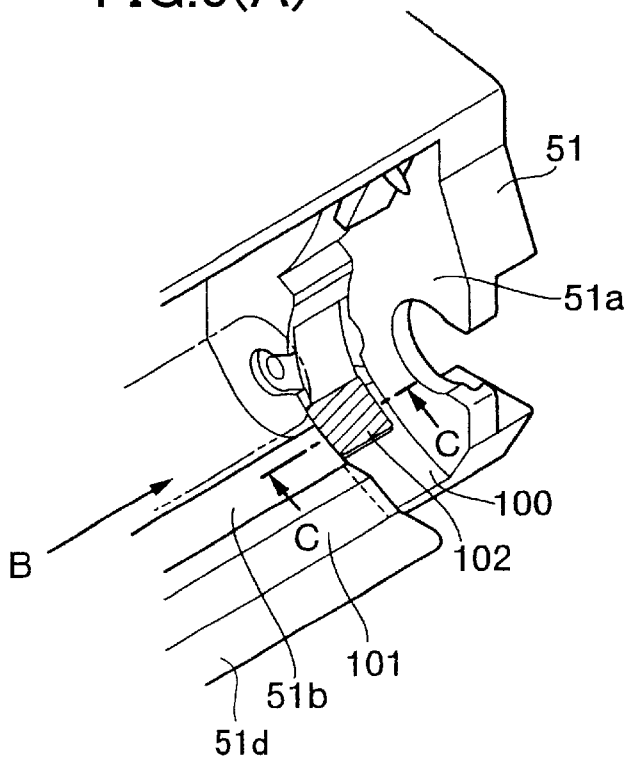
FIG. 5(A) is a partial perspective view showing the developing case after a side edge seal has been attached.
Figure 5B:
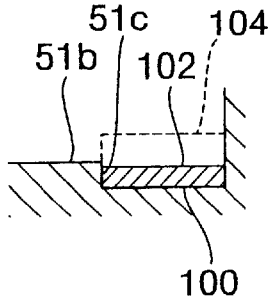
FIG. 5(B) is cross-sectional view showing the developing case and the side edge seal of FIG. 3(A)
Figure 6A:
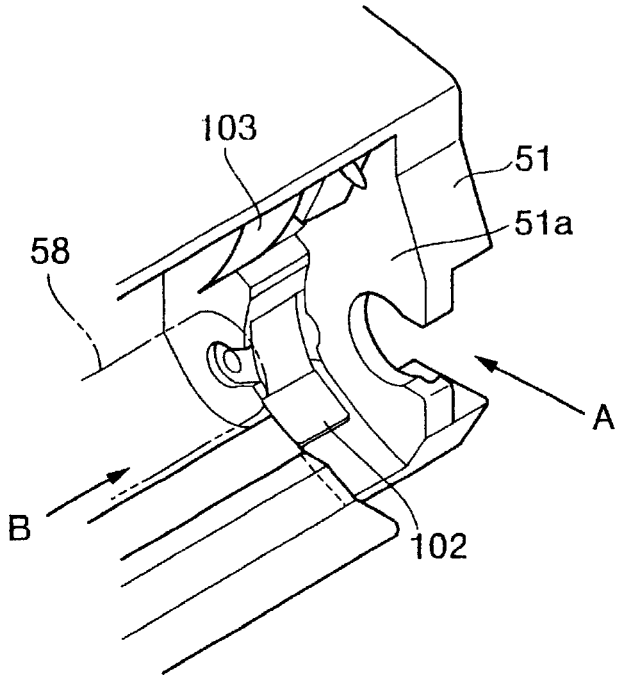
FIG. 6(A) is a partial perspective view showing the developing unit case after an upper side edge attachment film has been attached.
Figure 6B:
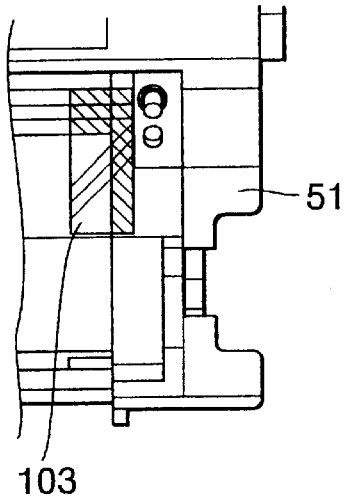
FIG. 6(B) is a partial plan view showing the developing case and seal configuration from a direction indicated by arrow A in FIG. 6(A)
Figure 6C:
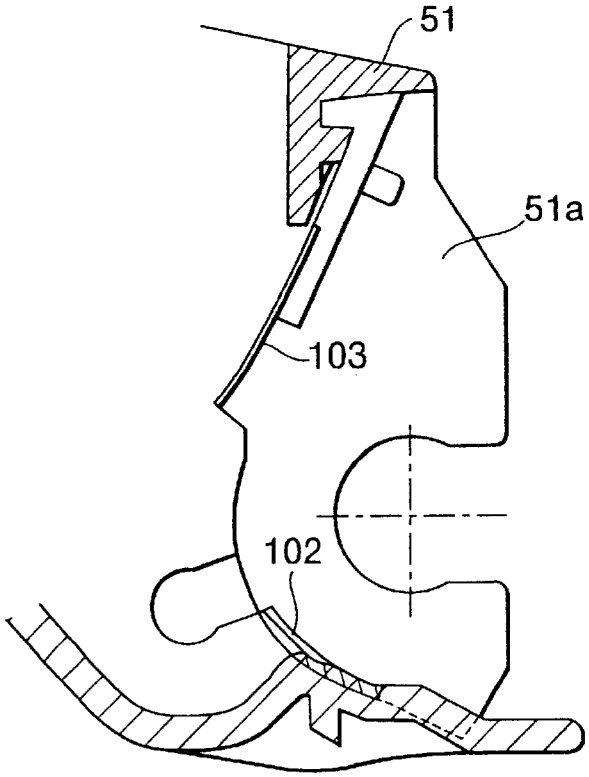
FIG. 6(C) is a cross-sectional view showing the developing case and seal configuration as viewed from the direction indicated by an arrow B in FIG. 6(A)
Figure 7A:
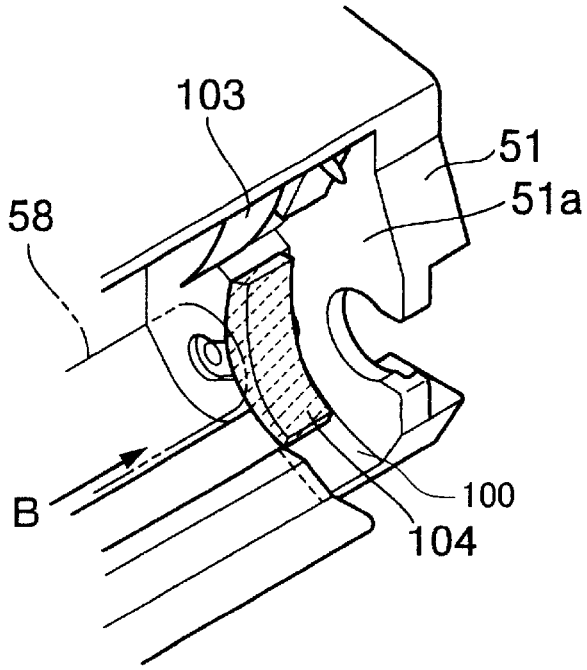
FIG. 7(A) is a partial perspective view showing the developing unit case after a side seal has been attached.
Figure 7B:
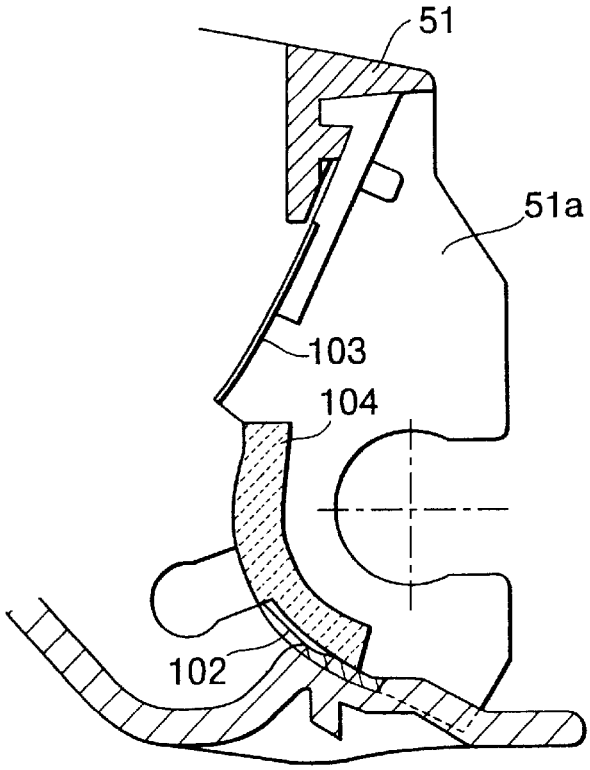
FIG. 7(B) is a cross-sectional view showing the developing case and seal configuration as viewed from the direction indicated by an arrow B in FIG. 7(A)
Figure 8A:
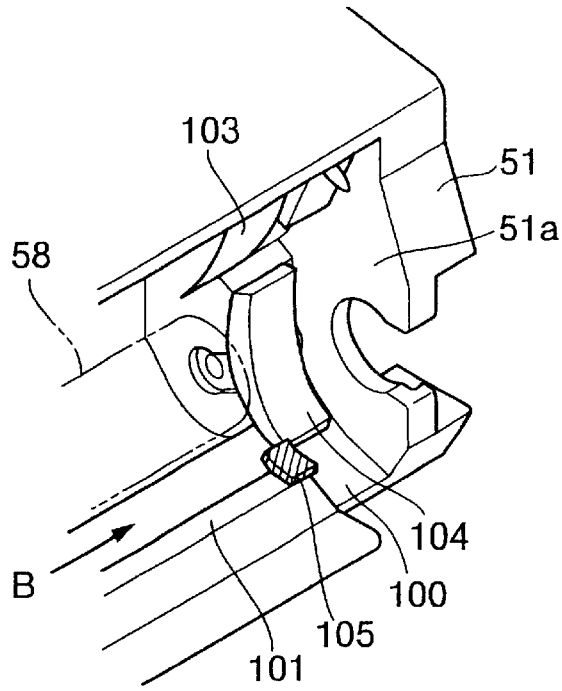
FIG. 8(A) is a partial perspective view showing the developing unit case after a lower side seal has been attached.
Figure 8B:
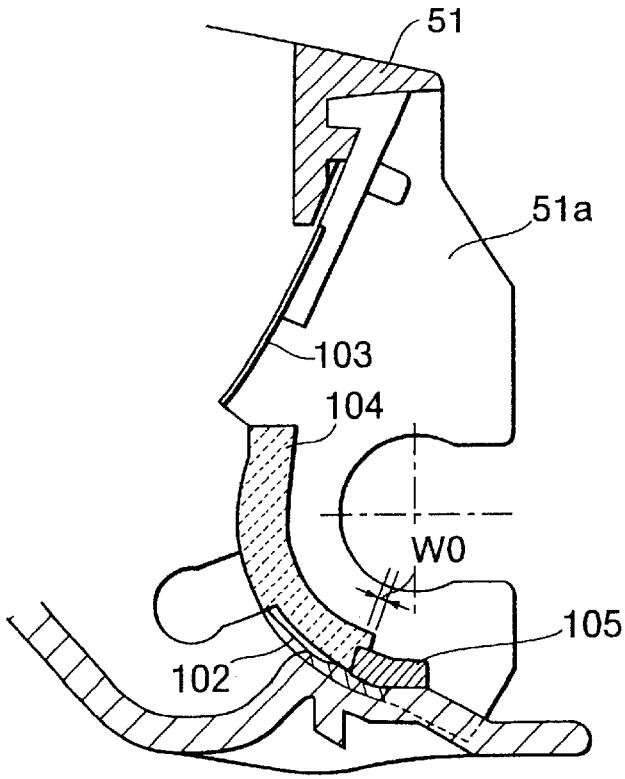
FIG. 8(B) is a cross-sectional view showing the developing case and seal configuration as viewed in the direction indicated by an arrow B In FIG. 8(A)
Figure 9A:
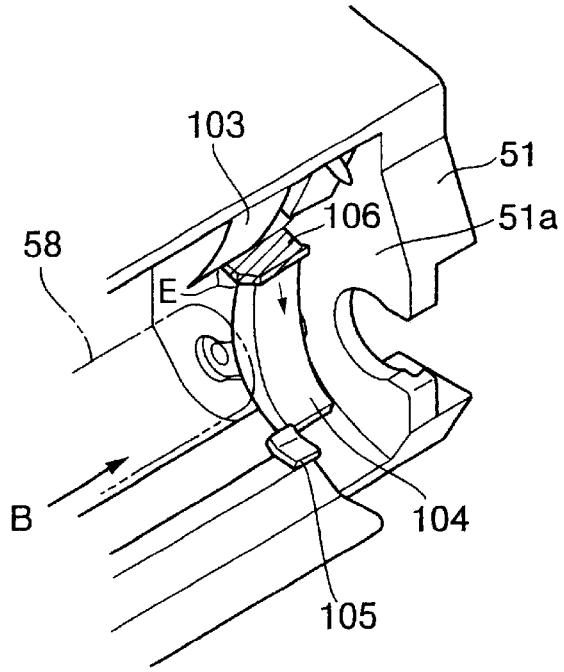
FIG. 9(A) is a partial perspective view showing the developing case after an end seal has been attached.
Figure 9B:
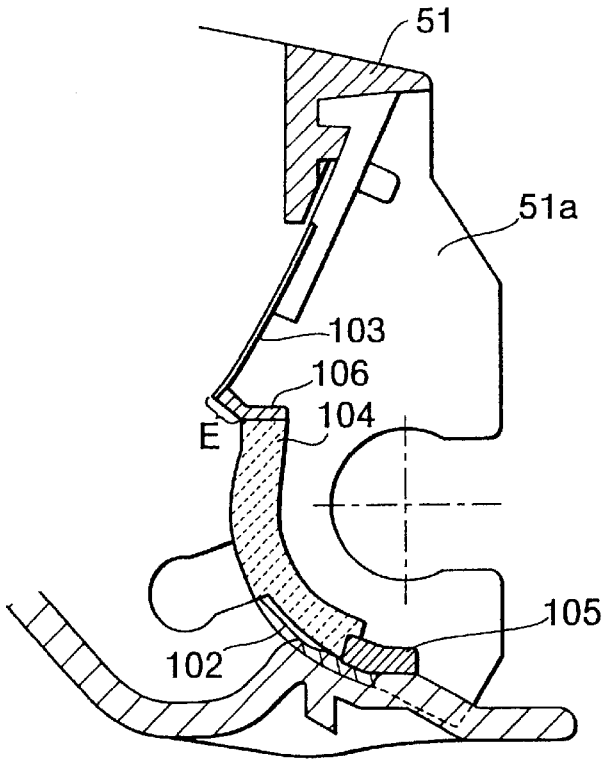
FIG. 9(B) is a cross-sectional view showing the developing case and seal configuration viewed from the direction indicated by an arrow B in FIG. 9(A)
Figure 10A:
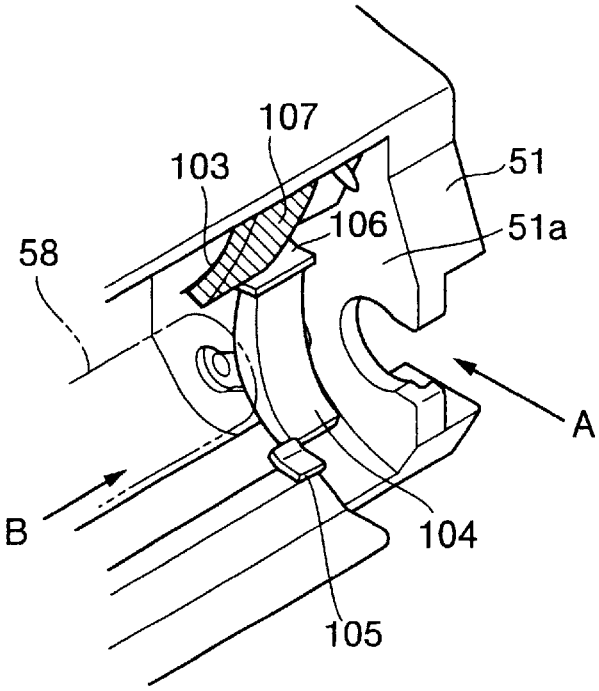
FIG. 10(A) is a partial perspective view showing the developing case after an upper side seal has been attached.
Figure 10B:
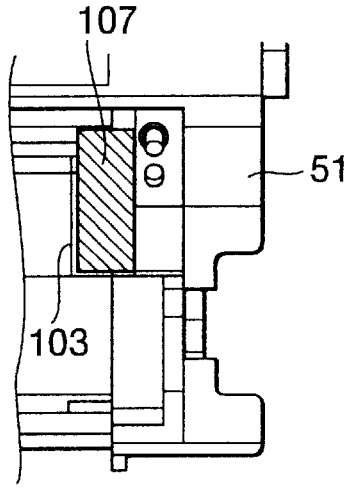
FIG. 10(B) is a plan view showing the developing case and seal configuration from the direction indicated by an arrow A in FIG. 10(A)
Figure 10C:
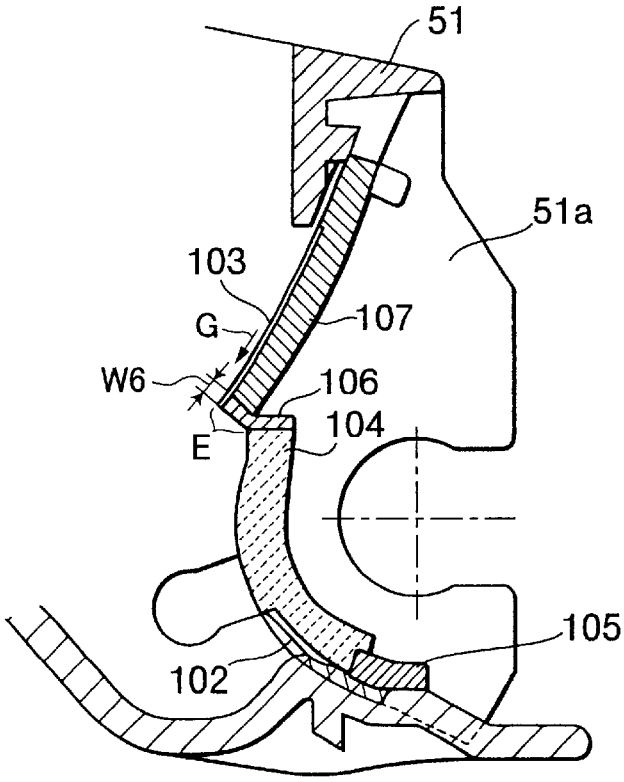
FIG. 10(C) is a cross-sectional view showing the developing case and seal configuration as viewed in the direction indicated by an arrow B in FIG. 10(A)
Figure 11:
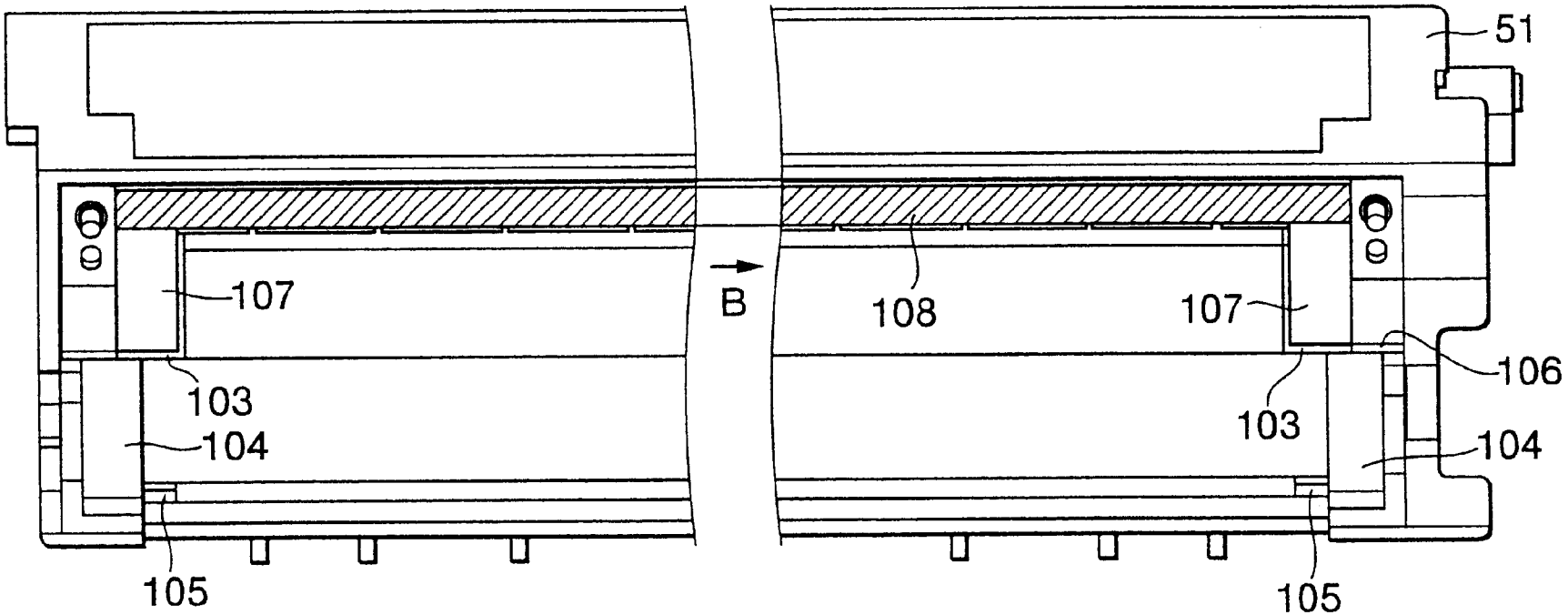
FIG. 11 is a front view showing the developing case after an upper seal has been attached.
Figure 12:
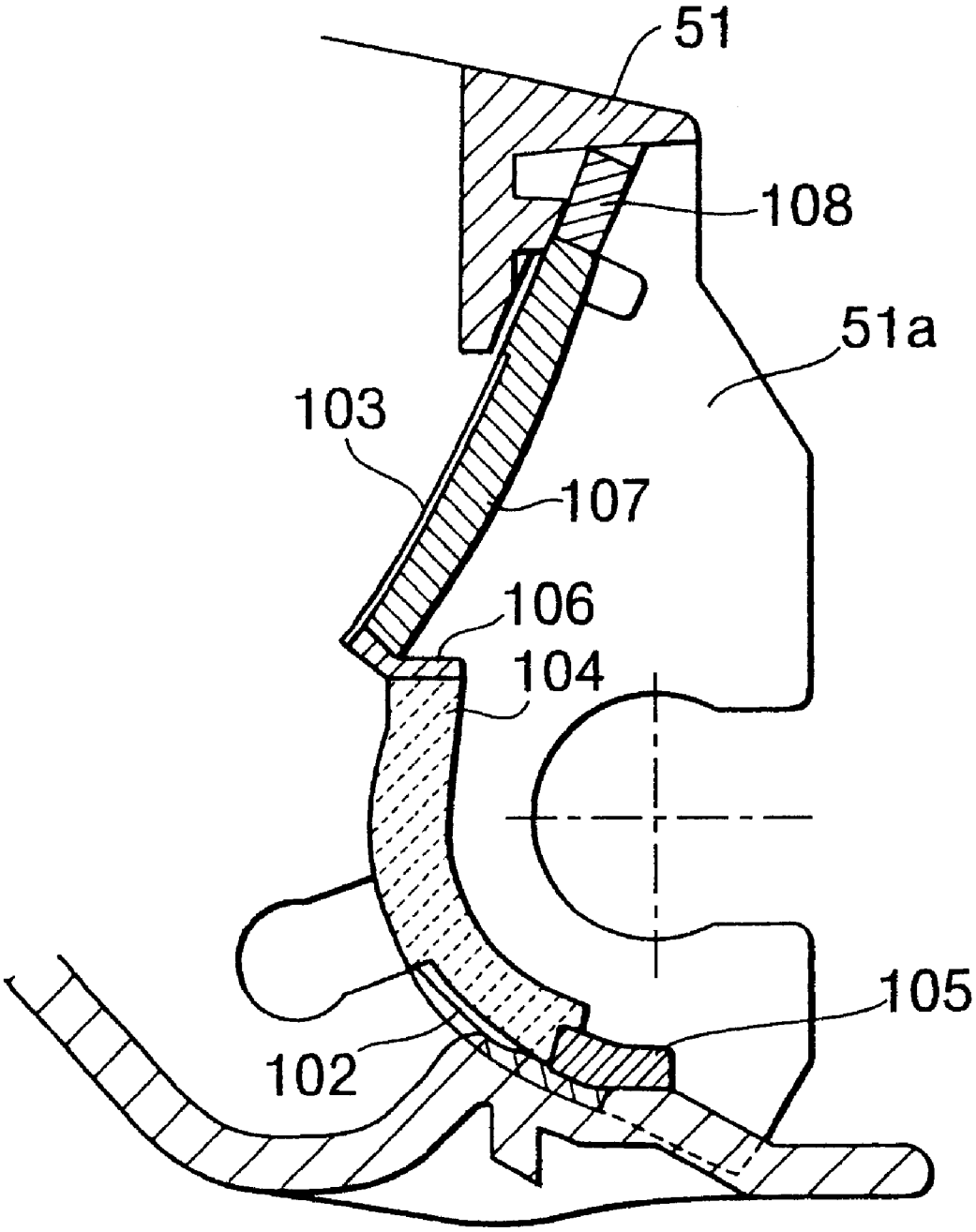
FIG. 12 is a cross-sectional view showing seal configuration as viewed from the direction indicated by an arrow B in FIG. 10(A)
Figure 13A:
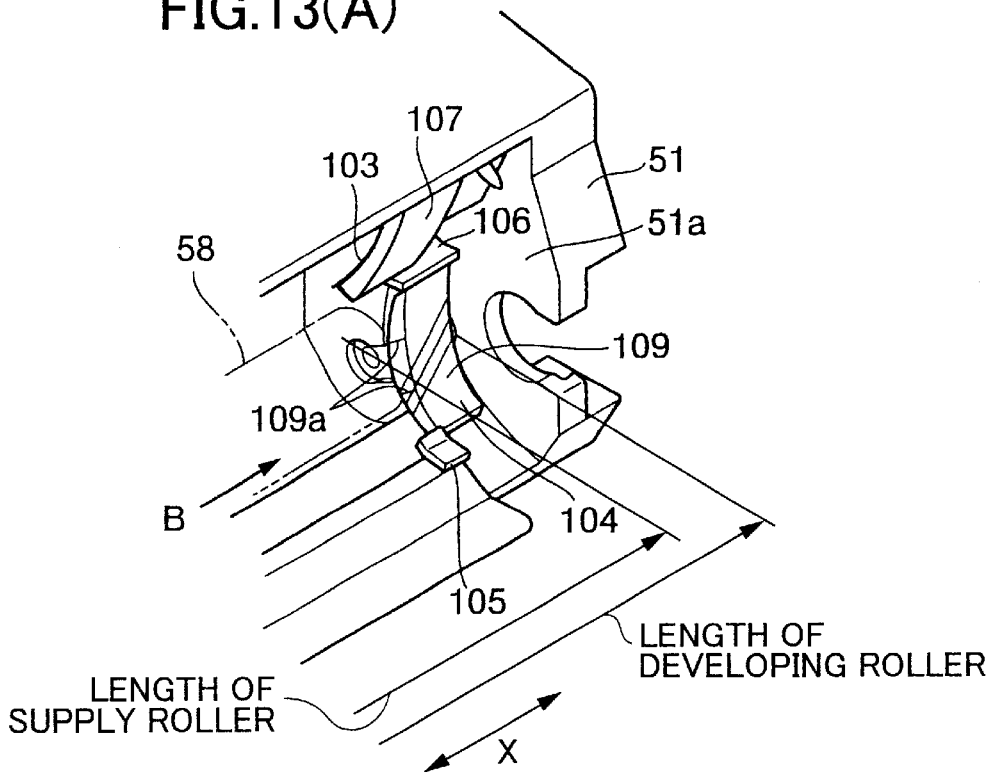
FIG. 13(A) is a partial-perspective view showing the developing case after an intermediate layer film has been attached.
Figure 13B:
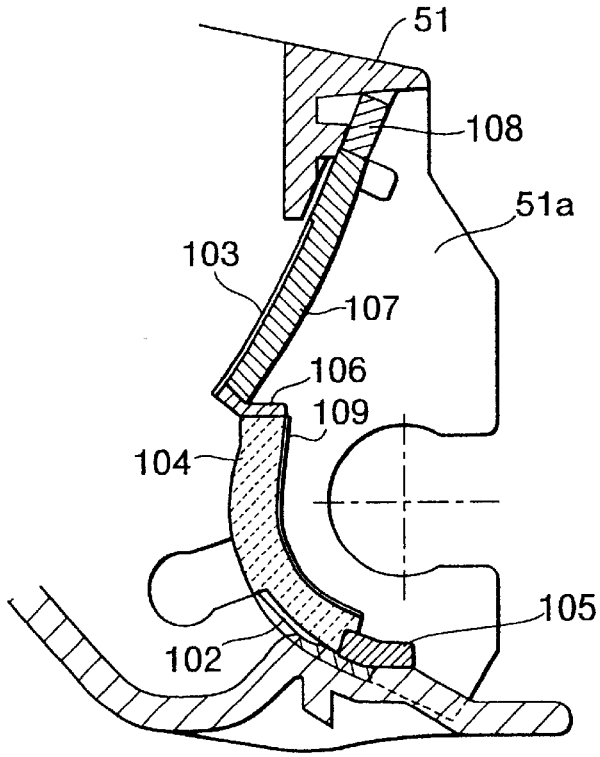
FIG. 13(B) is a cross-sectional view showing the seal portion from the direction indicated by an arrow B in FIG. 13(A)
Figure 14:
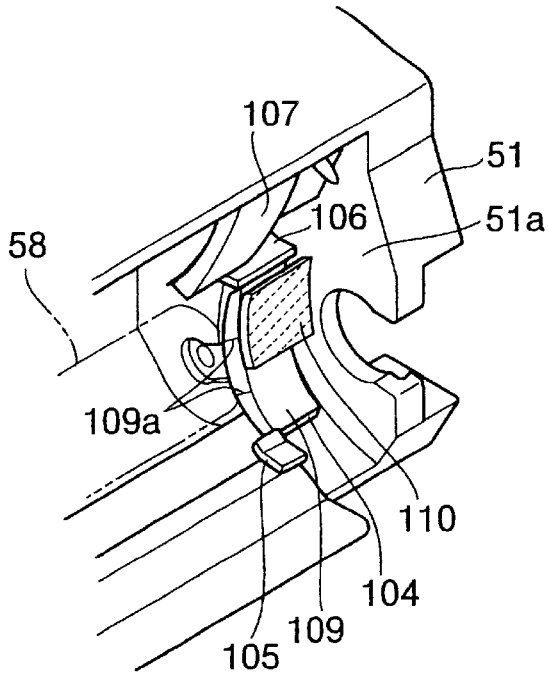
FIG. 14 is a partial perspective view showing the developing unit case after a side edge seal has been attached.
Figure 15:
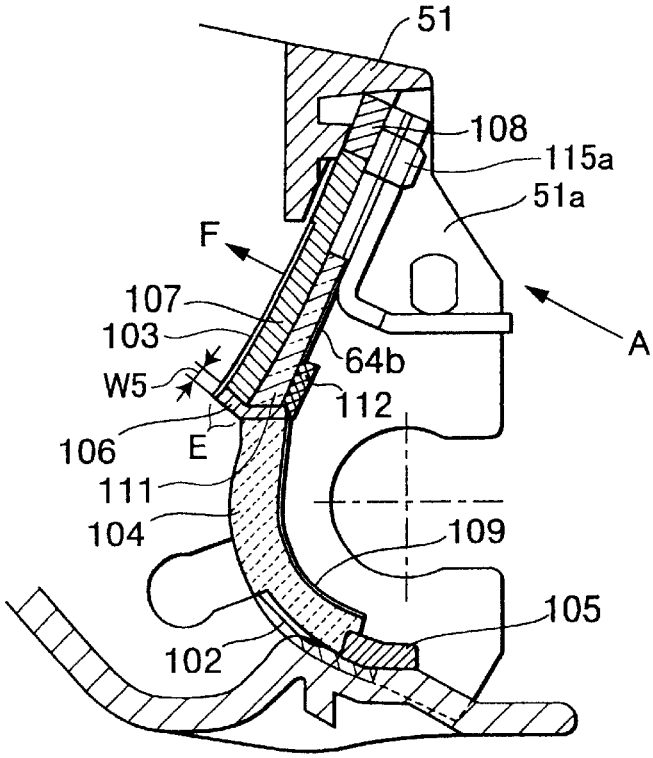
FIG. 15 is a cross-sectional view showing the developing case and seal configuration as viewed in a direction indicated by an arrow B in FIG. 13(A)
Figure 16A:
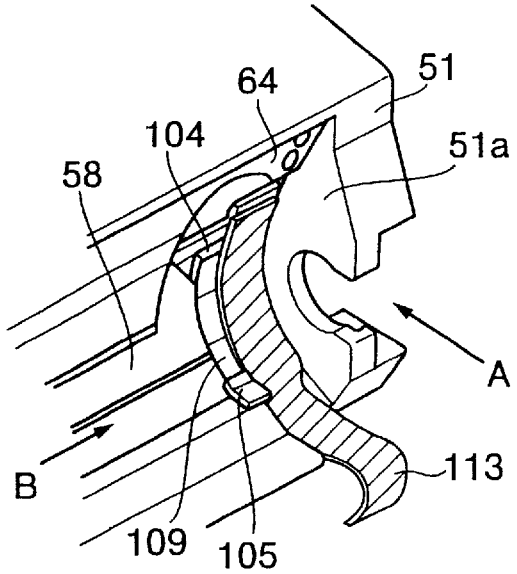
FIG. 16(A) is a partial perspective view showing the developing unit case after a Teflon™ felt contact member has been attached.
Figure 16B:
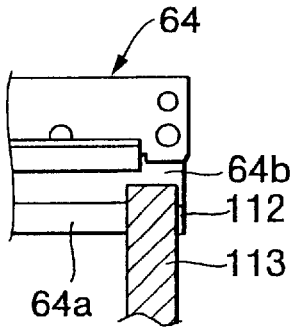
FIG. 16(B) is a plan view showing the seal configuration as viewed from a direction indicated by an arrow A in FIG. 16(A)
Figure 16C:
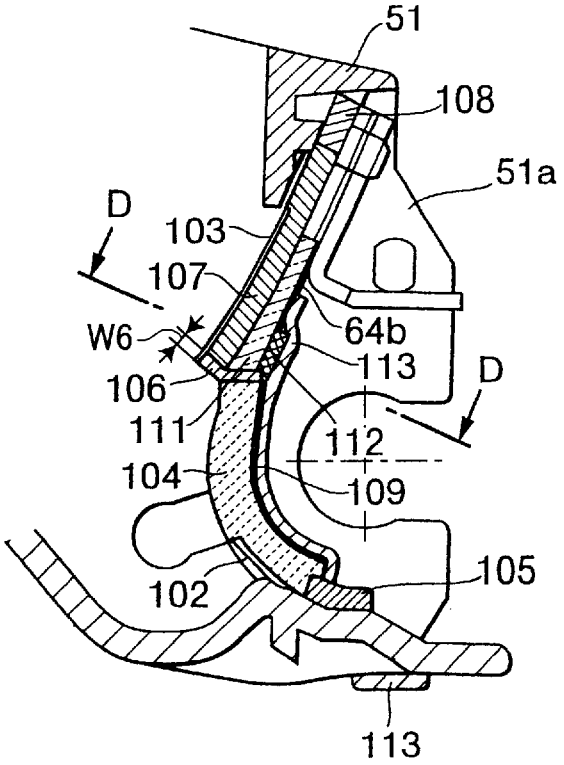
FIG. 16(C) is a cross-sectional view showing the developing case and the seal configuration as viewed from the direction indicated by an arrow B in FIG. 16(A)

As shown in FIGS. 3(A) and 3(B), other seal components 102 to 110, and 113 to 114 are also provided near the ends of the layer thickness regulating blade 64 for preventing toner leaks. The seal components 102 to 114 are introduced in the order of assembly in FIGS. 4(A) to 17(B). That is, the side edge seal 102 is shown in FIGS. 5(A) and 5(B), the PET film 103 is shown in FIGS. 6(A) to 6(C), the base seal 104 is shown in FIGS. 7(A) and 7(B). the lower side seal 105 is shown in FIGS. 8(A) and 8(B), the end seal 106 is shown in FIGS. 9(A) and 9(B), the upper side seal 107 is shown in FIGS. 10(A) to 10(C), the upper seal 108 is shown in FIGS. 11 and 12, the intermediate layer film 109 is shown in FIGS. 13(A) and 13(B), the side edge seal 110 is shown in FIGS. 14 and 15, the Teflon™ felt contact member 113 is shown in FIGS. 16(A) to 16(D), and the lower film 114 is shown in FIGS. 17(A) and 17(B). To facilitate understanding of the seal components 102 to 114 and how they interrelate, details of the seal components 102 to 114 will be explained along with the procedure for assembling the configuration, with reference to FIGS. 4(A) to 17(B).

Figure 4A:
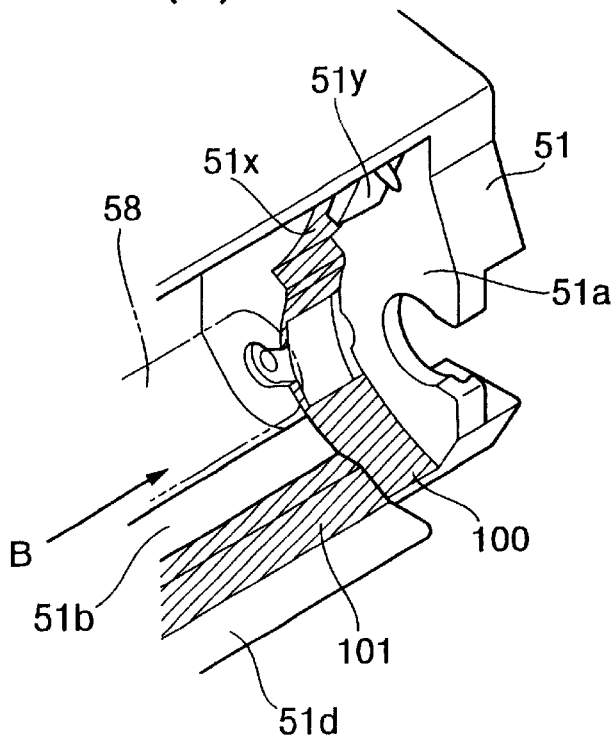
FIG. 4(A) is a partial perspective view showing the developing case before any seal configuration is attached.

The supply roller 58 is housed in the supply roller holding portion as indicated by two dot chain line in FIG. 4(A). The developing roller 59 is disposed in the developing chamber 57 so as to contact the side edge portion 51*a* of the developing case 51, with its rotational axis Q centered as shown in FIG. 2(B).

As indicated by hatching in FIG. 4(A), the inner surface of the developing case 51 includes a side seal attachment region 100 and a lower seal attachment region 101, where seal components are attached to the developing case 51. The side seal attachment region 100 and the lower seal attachment region 101 have been subjected to degreasing processes to increase attachment strength of the two-sided tape. The side seal attachment region 100 extends around the lengthwise end periphery of the developing roller 59 and includes a seal attachment surface 51*x*. The lower seal attachment region 101 extends below the developing roller 59 along length of the developing roller 59. The seal attaching region 101 is sandwiched between a bottom surface 51*b* and a front edge portion 51*d* of the developing roller holding portion.

Figure 4B:
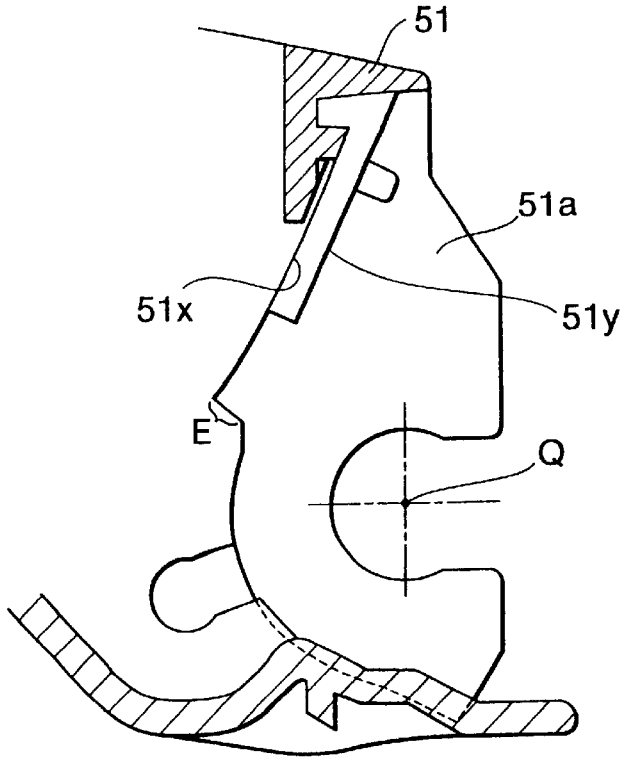
FIG. 4(B) is a cross-sectional view showing the developing case from the direction indicated by an arrow B in FIG. 4(A)

The developing case 51 in also formed with a blade attachment surface 51*y*. As shown in FIG. 3(B), the developer layer thickness regulating blade 64 is positioned on the blade attachment surface 51*y* to resiliently press the upper side seal 107 and the rear surface blade seal 111 in the thickness direction of the upper side seal 107 and the rear surface blade seal 111. As shown in FIG. 4(B), the seal attachment surface 51*x* is receded from the blade attachment surface 51*y* in the thickness direction by a step portion E that extends from the seal attachment surface 51*z* and that, as shown in FIG. 3(B), is located adjacent to ends of the developer layer thickness regulating blade 64 and the rear surface blade seal 111.

Figure 5C:
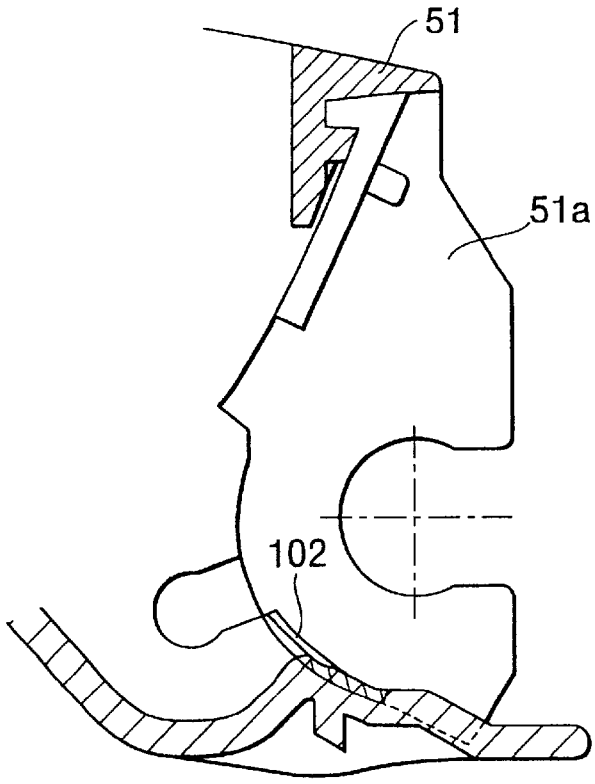
FIG. 5(C) is a cross-sectional view showing the developing case and seal configuration as viewed from the direction indicated by au arrow B in FIG. 5(A)

As shown in FIGS. 5(A) to 5(C), the side edge seal 102 is attached to the side seal attachment region 100 by two-sided tape. As shown in FIG. 5(B), the side seal attachment region 100 is formed receded lower than the bottom surface 51*b*, thereby forming a stop with an edge 51*c*. When attaching the side edge seal 102, the side edge surface of the side edge seal 102 is pressed into intimate contact with the edge 51*c* of the bottom surface 51*b*. The side edge seal 102 is formed from a sponge material that is softer than urethane sponge.

Next, as shown in FIGS. 6(A) to 6(C), the PET film 103 is attached by two-sided tape to the seal attachment surface 51*x*.

Then, as shown in FIGS. 7(A) and 7(B), the base seal 104 is attached to the side seal attachment region 100 over the side edge seal 102 by two-sided tape. The base seal 104 is formed from a urethane foam, such as Poron® produced by Rogers Corporation, which is relatively stiff compared to other foam materials. The base seal 104 is formed thick enough so that when the developing roller 59 is attached, the base seal 104 is compressed to produce a predetermined pressing force that presses the Teflon™ felt contact member 113 with a predetermined pressing force against the peripheral surface of the developing roller 59.

The following problem would occur if the side edge seal 102 was not provided. As indicated in dotted line in FIG. 5(B), the base seal 104 would be adhered directly to the side seal attachment region 100, with its edge surface in contact with the edge 51*c*. Because the base seal 104 is made from relatively stiff urethane sponge and the developing case 51 is made from stiff resin, that is because both the base seal 104 and the developing case 51 are relatively stiff, the seal between the base seal 104 and the developing case 51 would be weak. Toner that flows along the bottom surface 51*b* would enter between where the edge 51*c* and the base seal 104 contact each other. Also, the toner from the supply roller holding portion would leak out through this contact portion.

However, because the side edge seal 102 is provided in the present embodiment, a soft sponge is disposed in intimate contact with the stiff resin edge 51*c*. Therfore, toner can be reliably prevented from entering the contact portion between the edge 51*c* and the side edge seal 102. Also, as shown in FIG. 5(A), because the edge surface of the supply roller 58 rubs against the edge surface of the base seal 104, toner is prevented from leaking from between the supply roller 58 and the base seal 104.

Next, an shown in FIGS. 8(A) and 8(B), the lower side seal 105 is attached to the edge of the lower seal attachment region 101 by two-sided tape, in intimate contact with the base seal 104. FIG. 8(D) shows the seals 104, 105 when viewed from the side in a direction indicated by an arrow B in FIG. 8(A). As shown in FIG. 8(B), the lower side seal 105 and the base seal 104 partially overlap by an overlap region W0. In the present embodiment, the overlap region W0 is set to about 2 mm. The lower side seal 105 is formed from a soft urethane sponge.

With this configuration, toner can be prevented from leaking between the side seal attachment region 100 and the lower seal attachment region 101. Also, toner can be prevented from leaking between where the lower seal attachment region 101 and a movable portion of the lower seal 114 to be described later contact each other.

Next, as shown in FIGS. 9(A) and 9(B), the end seal 106 is attached on the upper end surface of the base seal 104 and the step portion B by two-sided tape. The end seal 106 is formed from a soft urethane sponge to a thickness of less than 2 mm, and desirably 1 mm or less. It should be noted that as shown in FIG. 3(B), the layer thickness regulating blade 64 is attached to the developing case 51 with its free end positioned near where the end seal 106 traverses the step portion E.

Then, as shown in FIGS. 10(A) to 10(C), the upper side seal 107 is attached to the developing case 51, both directly and through the PET film 103, by two-sided tape with its end in contact with the end seal 106. The upper side seal 107 is formed from soft urethane sponge. The PET film 103 provides a sufficiently large attachment region for attaching the upper side seal 107. Note that if the upper side seal 107 were adhered only to the developing case 51 without provision of the PET film 103, the adhering region would be only the small region indicated by hatching in FIG. 6(B).

When attaching the upper side seal 107, the lower edge surface of the upper side seal 107 is pressed in a direction indicated by an arrow G to contact and resiliently compress the end seal 106. By attaching the upper side seal 107 in this manner, the side edge surface of the end seal 106 rubs against the attachment surface of the developing case 51 and the end seal 106 is compressed to be a width W6.

The end seal 106 can not be adhered to the developing case 51 because its surface area is too small. However, because the end seal 106 is formed to thickness of 2 mm or less, fluctuation where the end seal 106 contacts the developing case 51 is suppressed to an extremely small amount. Accordingly, the end seal 106 can be prevented from vibrating significantly at its edge surface in association with vibration of the thickness regulating blade 64 and the upper side seal 107. Therefore, toner can be reliably prevented from leaking from the portion between the side surface of the end seal 106 and the developing case 51.

Next, as shown in FIGS. 11 and 12, the upper seal 108 is attached to the developing case 51 above the upper side seal 107. The upper seal 108 is formed from soft urethane sponge in an elongated shape. As shown in FIG. 3(B), the upper seal 108 contacts the rear surface of the layer thickness regulating blade 64, once the layer thickness regulating blade 64 is attached to the developing case 51.

With this configuration, even when toner clouds up within the toner holding chamber 52, the upper seal 108 will prevent the toner from leaking. The upper seal 108 also prevents toner from leaking when the developing unit 50 is turned upside down.

Next, as shown in FIGS. 13(A) and 13(B), the intermediate layer film 109 is attached to the base seal 104 by two-sided tape. The intermediate layer film 109 is formed from PET film. As shown in FIG. 13(A), the intermediate layer film 109 is wider than the base seal 104 in directions X. One edge of the intermediate layer film 109 protrudes toward the center of the developing case 51, and serves as a partial barrier between the toner in the developing chamber 57 and the contact position where the developing roller 59 and the Teflon™ felt contact member 113 contact each other. The intermediate layer film 109 disperses pressure of the toner against the contact position, so that toner leaks can be reliably prevented without having to press the base seal 104 too forcefully against the developing roller 59.

Also, the inward-protruding edge of the intermediate layer film 109 is cut at sections 109*a* from the center side of the developing case 51 in the direction X. This prevents the intermediate layer film 109 from tearing because of deformation caused by load in association with rotation of the developing roller 59 and the supply roller 58.

Next, as shown in FIG. 14, the side edge seal 110 is attached to the upper portion of the intermediate layer film 109 by two-sided tape. The side edge seal 110 is formed from sponge and prevents a gap from opening between the plate spring 64*b* and the intermediate layer film 109 so that toner leaks can be prevented.

Then, as shown in FIG. 13, the layer thickness regulating blade 64 is attached to the developing case 51 so that the rear surface blade seal 111 pressingly contacts the upper side seal 107. As described above, the support portion 64*c* is attached by fitting the boss hole 115 on the boss 115*a* of the developing case 51, and by fitting the screw hole 116 on a screw. When the screw is screwed tight, the rear surface blade seal 111 is pressed in a direction indicated by an arrow F in FIG. 15. This resiliently compresses the rear surface blade seal 111 and the upper side seal 107, so that the lower surface of the rear surface blade seal 111 and the lower end surface of the upper side seal 107 both move in the direction indicated by the arrow F.

As mentioned previously, the layer thickness regulating blade vibrates in association with rotation of the developing roller. Therefore. it is conceivable that the rear surface blade seal 111 will also vibrate in the direction indicated by the arrow P and in the opposite direction.

However, because rear surface blade seal 111 and the and seal 106 are formed from soft urethane sponge, the soft urethane sponges maintain a satisfactory sealing condition between where the rear surface blade seal 111 and the end seal 104 contact each other, even if the rear surface blade seal 111 vibrates. As a result, toner can be reliably prevented from leaking through this contact portion.

Also, a good seal is maintained between the rear surface blade seal 111 and the upper side seal 107, because both of these are made from soft urethane sponge. Accordingly, even if vibration of the plate spring 64*b* is transmitted to the rear surface blade seal 111 and the upper side seal 107, a satisfactory seal can be maintained. Toner can be reliably prevented from leaking between this contact portion also.

In other words, a good seal can be maintained between the layer thickness regulating blade 64 and the developing case 51, where the plate spring 64*b* is adhered to the rear surface blade seal 111, where the upper side seal 107 is adhered to the developing case 51, and where the rear surface blade seal 111 contacts the upper side seal 107.

Figure 16D:
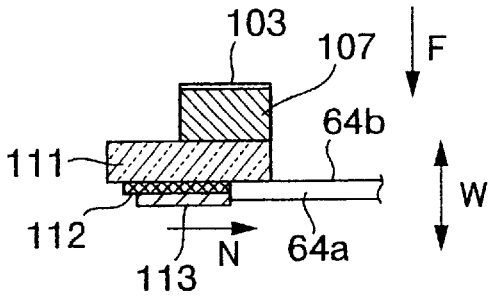
FIG. 16(D) is a cross-sectional view taken along the line D—D in FIG. 16(C)
Figure 17A:
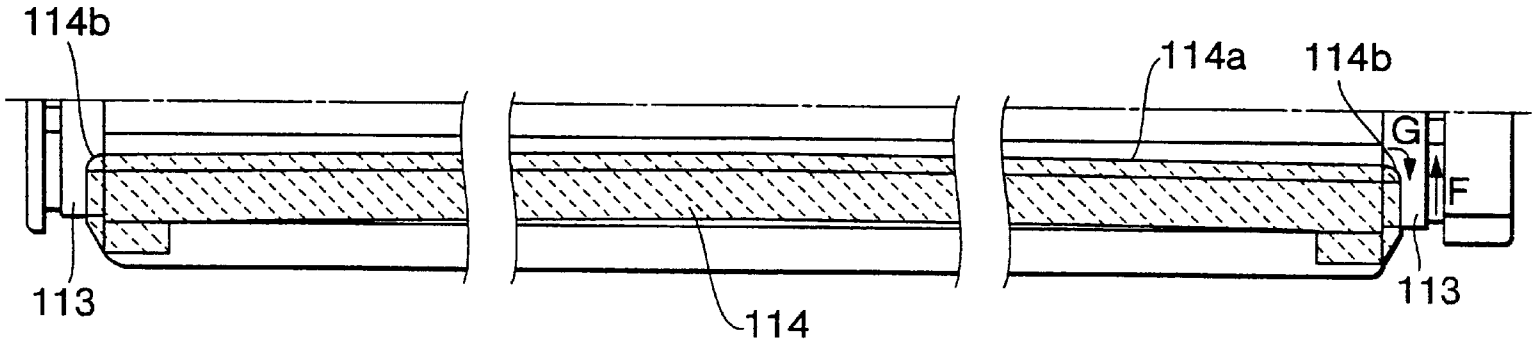
FIG. 17(A) is a plan view showing a lower seal attachment region of the developing case with a lower film attached thereto.
Figure 17B:
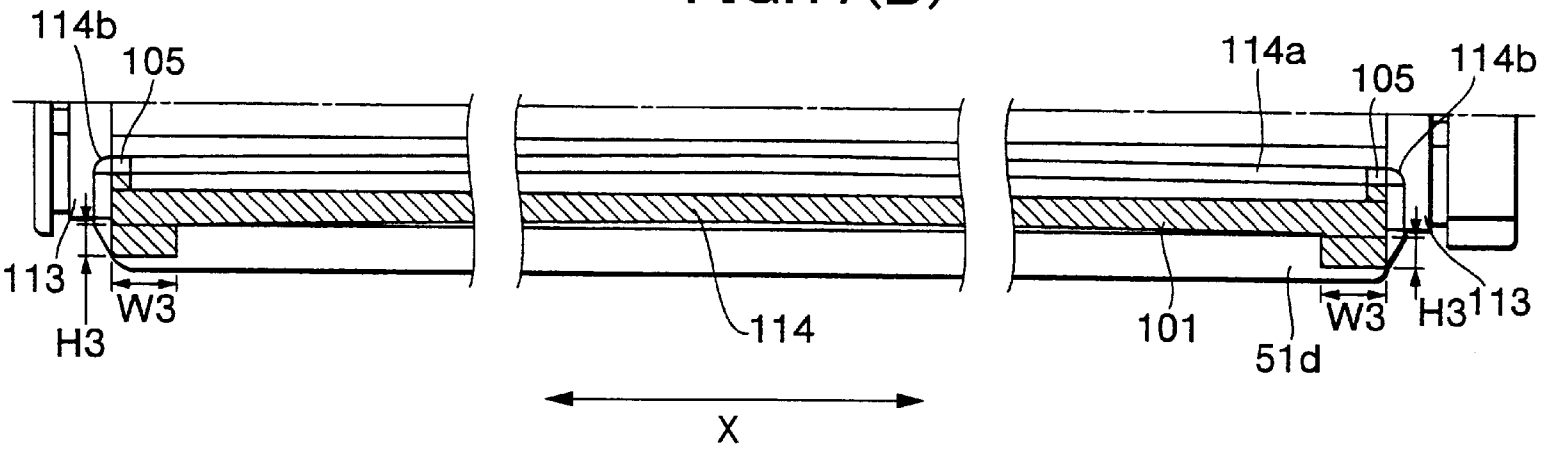
FIG. 17(B) is a plan view showing the lower seal attachment region with the lower film.

As shown in FIG. 16(D), the plate spring 64*b* also receives pressing force from the upper side seal 107 and the rear surface blade seal 111 in the direction F. However, the plate spring 64*b* will not bend under this pressing force, because the rear surface blade seals 111 are formed to the width W1 and are therefore wider than the width W2 of the exposed portions of the plate spring 64*b*. That is, because the rear surface blade seal 111 is wider than the exposed portion, they each cover a region wider than a region wider than a region that corresponds to the exposed portions in the direction X. Therefore, the upper side seal 107 and the rear surface blade seal 111 press not only the plate spring 64*b*, but also the pressing member 64*a*, so that the plate spring 64*b* will not bend. Aa a result, toner leaks caused by the plate spring 64*b* bending can be prevented.

As described before, the rear surface blade seal 111 is formed to the height H1, which is greater than the height H2 of the plate spring 64*b*. Therefore, the rear surface blade seal 111 covers across entire region of the plate spring 64*b* in the direction Y. With this configuration, toner can be prevented from leaking from the side edges of the plate spring 64*b* at its rear surface.

According to the present embodiment, toner can be reliably prevented from leaking not only from between the pressing member 64*a* and the developing roller 59 but also from between the pressing member 64*a* and the front surface resilient foam seal 112.

Next, as shown in FIG. 16(A) to 16(C), one of the Teflon™ felt contact members 113 is attached by two-sided tape to the plate spring 64*b*, the front surface resilient foam seal 112, the intermediate layer film 109, and the side seal attachment region 100. As shown in FIG. 16(B) and 16(C), the leading edge of the Teflon™ felt contact member 113 is attached to the front surface of the plate spring 64*b*. Then, the following portion of the Teflon™ felt contact member 113 is attached to cover the front surface resilient foam seal 112, the intermediate layer film 109, and the side seal attachment region 100. in this way, each contact member 113 is attached to the corresponding one of the exposed end portions of the plate spring 64*b*, through the corresponding foam seal 112, and extends to cover the corresponding exposed end portion. Each foam seal 112 is interposed between the corresponding contact member 113 and the corresponding exposed end portion. With this configuration, toner can be reliably prevented from leaking from both ends of the pressing member 64*a*. Also, each felt contact member 113 extends to a corresponding base seal 104, and is attached to the base seal 104 through the corresponding intermediate layer film 109. With this configuration also, toner can be reliably prevented from leaking from both ends of the pressing member 64*a*.

When attaching the Teflon™ felt contact member 113, the Teflon™ felt contact member 113 is pressed against the pressing member 64*a* so that the Teflon™ felt is brought into intimate contact with the contact region 64*d* of the pressing member. As described above, the contact region 64*d* has the width W5 of 4 mm or greater. That is, the pressing member 64*a* contacts the Teflon™ felt contact member 113 with the contact region 64*d* which has an efficiently great surface area. Therefore, toner can be prevented from leaking from the contact portion between the pressing member 64*a* and the Teflon™ felt contact member 113.

Further, because the plate spring 64*b* is formed longer than the pressing member 64*a* in the directions X as shown in FIGS. 2(A) and 2(B), the plate spring 64*b* covers where the pressing member 64*a* and the Teflon™ felt contact member 113 contact each other. Therefore, the plate spring 64*b* blocks toners from entering between the pressing member 64*a* and the Teflon™ felt contact member 113, thereby preventing toner leaks.

Also, as shown in FIGS. 16(B) to 16(D), the Teflon™ felt contact member 113 is attached over the plate spring 64*b* at the side of the pressing member 64*a*. Therefore, the fibers of the Teflon™ felt contact member 113 will not enter between the contact portion between the pressing member 64*a* and the developing roller 59. No gap will be opened between the pressing member 64*a* and the developing roller 59 by fibers of Teflon™ felt contact member 113. As a result, toner can be reliably prevented from leaking between the pressing member 64*a* and the developing roller 59.

Further, because the Teflon™ felt contact member 113 covers the plate spring 64*b*. the Teflon™ felt contact member 113 moves with movement of the plate spring 64*b*. Therefore, the Teflon™ felt contact member 113 will not interfere with the movement of the plate spring 64*b*. The pressing force of the layer thickness regulating blade 64 against the developing roller 59 can be maintained to an appropriate level.

Moreover, because the front surface resilient foam seal 112 is interposed between the plate spring 64*b* and the Teflon™ felt contact member 113 as shown in FIGS. 16(C)

and 16(D), the front surface resilient foam seal 112 absorbs repulsive force of the developing roller 59 against the Teflon™ felt contact member 113 when the Teflon™ felt contact member 113 is strongly pressed against the developing roller 59. Therefore. the Teflon™ felt contact member 113 can be pressed against the developing roller 59 with a pressing force sufficient for preventing toner leaks, without weakening the pressure of the pressing member 64*a* against the developing roller 59 near the side ends of the developing roller 59.

The silicon rubber that forms the pressing member 64*a* can wear down over long periods of use. However, as shown in FIG. 16(D) the combined thickness of the front surface resilient foam seal 112 and the Teflon™ felt contact member 113 is formed thicker than the thickness of the pressing member 64*a*. With this configuration, when the pressing member 64*a* is worn down by a certain amount, the plate spring 64*b* will compress the front surface resilient foam seal 112 by an equivalent amount. Therefore, the pressing member 64*a* will press against the developing roller 59 by constant strength, so that the toner can be reliably prevented from leaking at the contact portion between the pressing member 64*a* and the developing roller 59.

In the present embodiment, the pressing member 64*a* has a thickness of 1.5 mm in a thickness direction W. The front surface resilient foam seal has a thickness of 1.1 mm and the Teflon™ felt contact member 113 has a thickness of 0.8 mm in the thickness direction W. In other words, the combined thickness of the front surface resilient foam seal 112 and the Teflon™ felt contact member 113 is thicker than the thickness of the pressing member 64*a* by 0.4 mm. This 0.4 mm is a compression amount that the front surface resilient foam seal 112 and the Teflon™ felt contact member 113 can be compressed before matching the thickness of the pressing member 64*a*. If the front surface resilient foam seal 112 is formed thicker, then its repulsion force also increases. Results of experiments indicate that increased repulsion force undesirably changes pressing force of the pressing member 64*a* against the developing roller 59 at ends of the developing roller 59.

In the present embodiment, when the Teflon™ felt contact member 113 and the front surface resilient foam seal 112 are attached, they are pressed in a direction indicated by an arrow N in FIG. 16(D) against the side surface of the pressing member 64*a*. As a result, both the Teflon™ felt contact member 113 and the front surface resilient foam seal 112 are compressed by, in the present embodiment. 0.5 mm. This configuration prevents toner from leaking between contact areas between the pressing member 64*a* and the Teflon™ felt contact member 113 and between the pressing member 64*a* and the front surface resilient foam seal 112 without adversely affecting pressing force of the pressing member 64*a* against the developing roller 59.

According to the present embodiment, the pressing member 64*a* is disposed between the side seals 104. Therefore, toner will always be present between the pressing member 64*a* and the developing roller 59 across the entire length of the developing roller 59. Therefore, although the pressing member 64*a* is formed from conductive silicon rubber, current will now flow directly from the layer thickness regulating blade 64 to the developing roller 59 when a voltage is developed between the layer thickness regulating blade 64 to the developing roller 59.

Applying voltage to the layer thickness regulating blade 64 can aid charging of the toner. Also, applying voltage having the same polarity as the toner can discourage oppositely charged toner from passing between the pressing member 64*a* and the developing roller 59. This reduces the generation of fogging.

Because the pressing member 64*a* is formed from silicon rubber, the pressing member 64*a* maintains good charging properties so that the toner can be properly charged by abrasion.

Next, the lower film 114 is attached as shown in FIGS. 17(A), 17(B), and 3(A). The lower film 114 can be formed from either PET sheet or urethane rubber film. The lower film 114 is formed from the PET sheet in the present embodiment. As shown in FIG. 17(B), the lower film 114 is attached to a portion of the lower seal attachment region 101, a portion of the front edge portion 51*d* of the developing case 51, and a portion of the lower side seal 105 by two-sided tape. The portion of the front edge portion 51*d* covered by the lower film 114 has a width W3 in the direction X and a height H3 in the direction Y. Because the lower film 114 is adhered not only to the lower seal attachment region 101, but also to the portion of the front edge portion 51*d*, the lower seal 114 is not easily peeled off even if the pressing force of the developing roller 59, the lower film 114, and the Teflon™ felt contact member 113 is increased to a certain amount.

Also, the side ends of the lower film 114 are placed over the Teflon™ felt contact member 113. With this configuration, when the developing roller 59 is mounted into the developing roller housing portion, the developing roller 59 presses the lower film 114 against the Teflon™ felt contact member 113, thereby eliminating any gaps between the Teflon™ felt contact member 113 and the lower film 114. Toner can be reliably prevented from leaking between the Teflon™ felt contact member 113 and the lower film 114.

As described above, according to the present embodiment, two soft urethane sponge member are disposed in contact with each other between the developing case 51 and all components that might vibrate in association with rotation of the developing roller 59. As a result, toner can be reliably prevented from leaking between the layer thickness regulating blade 64 and the developing case 51.

Such sponge members can only be adhered effectively to a surface of a potentially moving component, if the surface extends perpendicular to the direction in which the sponge member will be compressed by the movement. Further, in order to increase precision during assembly, each sponge member can only can be adhered to one of two confronting surfaces, even if both surfaces extend in the direction of sponge compression. Although remaining surfaces, such as the lower end surface of the upper side seal 107, vibrate in association with rotation of the developing roller 59, the sponge members are provided on such surfaces also, so toner can be reliably prevented from leaking between such remaining surfaces.

When a edge seal sponge member, such as the end seal 106, is provided in contact with such a remaining surface, such as the lower surface of the upper side seal 107, then the sponge seal member will rub against the developing case 51 as the sponge seal member compressingly deforms. However, according to the present invention, the thickness of such a sponge seal member is set to 2 mm or less before being deformed by compression and desirably 1 mm or less. Therefore, the deformation amount can be suppressed to a small amount so that toner can be reliably prevented from leaking.

Next, relationship between thickness of such an edge seal and toner leakage will be described. Here, the edge seals 106 are raised as an example of an edge seal. In experiments, the edge seals 106 were prepared with various thickness of 1.1 mm, 1.5 mm, 2.0 mm, and 2.5 mm before compression. Each end seal 106 was used in a device to print 15,000 consecutive sheets. Whether or not toner leak was investigated. The results of these experiments are shown in Table 1.

TABLE 1

| Thickness of Edge Seal | Extent of Toner Leakage during Endurance Test |
|---|---|
| 1.0 mm | no toner leakage (acceptable up to 15,000 printed sheets) |
| 1.5 mm | no toner leakage (acceptable up to 15,000 printed sheets) |
| 2.0 mm | slight toner leakage, (acceptable up to 15,000 printed sheets) |
| 2.5 mm | extensive toner leakage (unacceptable by 10,000 printed sheets) |

As can be seen in a Table 1, 15,000 sheets were printed without any toner leakage when the end seal 106 with the thickness of 1.0 mm or 1.5 mm was used. Slight toner leakage was observed when the end seal 106 with the thickness of 2.0 mm is used. However, toner leakage amount was not sufficient to cause any problems during operation of actual image forming operations. It is believed that when the end seal 106 is formed to a thickness of less than 2.0 mm, the side edge surface of the end seal 106 moves only slightly in association with vibration of the layer thickness regulating blade 64 so that only a small amount of toner leaks.

When the end seal 106 having the thickness of 2.5 mm, toner leakage could be observed by the time 10,000 sheets were printed. It is assumed that the end seal 106 was too thick so that the amount in which the end seal 106 moved in association with vibration of the layer thickness resting blade 64 was sufficiently large to cause toner leaks.

From the results of these experiments, it was determined that it is desirable for such sponge seal member be 2.0 mm or less thick or more desirably 1.0 mm thick.

As described above, toner can be reliably prevented from leaking from above and below, and from both ends of, the developing roller 59 even when polymerized toner, which has a very small particle diameter and high fluidity, is used.

Because polymerized toner having high fluidity is used in the present embodiment, extremely fine images can be formed.

While the invention has been described in detail with reference to the specific embodiment thereof, it would be apparent to those skilled in the art that various changes and modifications may be made therein without departing from the spirit of the invention.

For example, in the present embodiment, the front surface resilient foam seal 112 is provided between the plate spring 64*b* and the Teflon™ felt contact member 113. However, when urethane rubber or other wear resistant material is used to form the pressing member 64*a*, the front surface resilient foam seal 112 can be dispensed with.

Also, the Teflon™ felt contact member 113 can be dispensed with. In this case, a sponge side seal, such as the base seal 104, can be elongated to ride up over the plate spring 64*b* and cover the front surface blade seals 112. With this configuration also, toner can be reliably prevented from leaking because contact at both ends of the pressing member 64*a* is between two sponge members.

According to the present embodiment, the drum cartridge case 2*a* that includes the developing unit 50 is freely detachable from the main body of the laser beam printer 1. However, only the developing unit 50 need be formed detachable from the body of the image forming device 1. Alternatively, the drum cartridge case 2*a* and the developing unit 50 can be provided integrally in a process cartridge that is detachable from the main body of the beam printer 1. Further, the developing unit 50 need not be detachable from the main body of the laser beam printer 1 at all.

By applying the present invention to a developing cartridge or process cartridge, toner can be reliably prevented from leaking at the time of replacement. Even when the image forming device 1 is a non-portable desk top printer, toner will not stain the inside of the image forming device 1 even if the laser beam printer 1 is vibrated or moved around.

What is claimed is:

1. A developing device for developing a latent static-electric image into a visible image from developer, the developing device comprising:

a developing case for holding developer, the developing case being formed with an elongated opening;

a developer bearing body disposed in the opening of the developing case, with lengthwise ends of the developer bearing body rotatably supported on the developing case;

a developer layer thickness regulator including:

a pressing member that is formed from rubber or resin and that extends in a lengthwise direction of the developer bearing body; and a plate spring member that supports the pressing member pressingly against an outer periphery of the developer bearing body to form a thin layer of developer on the developer bearing body, the plate spring member extending in the lengthwise direction of the developer bearing body to a longer length than the pressing member and the pressing member being separated from the lengthwise ends of the plate spring member, thereby leaving end portions of the plate spring member uncovered by the pressing member; and contact members each for slidingly contacting a corresponding peripheral surface of the developer bearing body near a corresponding lengthwise end of the developer bearing body, each contact member being attached to a corresponding one of the end portions of the plate spring member and extending to cover the corresponding end portion.

2. A developing device as claimed in claim 1, further comprising base seals attached to the developing case and each facing a corresponding peripheral surface of he developer bearing body near a corresponding lengthwise end of the developer bearing body, each said contact member further extending to said corresponding base seal and being attached to the corresponding base seal.

3. A developing device as claimed in claim 2, wherein the base seals are formed from a resilient foam material.

4. A developing device as claimed in claim 1, further comprising resilient foam seals each interposed between a corresponding end portion of the plate spring member and a corresponding contact portion, the contact portions being attached to the corresponding end portion of the plate spring member through a corresponding base seal.

5. A developing device as claimed in claim 4, wherein the pressing member contacts each said resilient foam seal along a length of 4 mm or greater.

6. A developing device as claimed in claim 1, wherein the pressing member is formed from silicon rubber.

7. A developing device as claimed in claim 1, wherein the pressing member has conductivity.

8. A developing device as claimed in claim 1, wherein the developer is a polymerized toner formed by polymerization techniques.

9. A developing device as claimed in claim 1, wherein the developer bearing body is a resilient roller having conductivity.

10. A developing device as claimed in claim 1, wherein the developing case is a cartridge case adapted for free attachment and detachment with respect to an image forming device that has at least a photosensitive body.

11. A developing device as claimed in claim 1, wherein the developing case is a cartridge case adapted for free attachment and detachment with respect to a process cartridge that has at least a photosensitive body.

12. A process cartridge adapted for free attachment and detachment with respect to an image forming device, the process cartridge comprising:

a photosensitive body formed with a latent static-electric image on its surface; and a developing device for developing the latent static-electric image on the photosensitive body into a visible image from developer, the developing device including:

a developing case for holding developer, the developing case being formed with an elongated opening;

a developer bearing body for transporting developer from the developing case to the photosensitive body, the developer bearing body being disposed in the opening of the developing case, with lengthwise ends of the developer bearing body rotatably supported on the developing case;

a developer layer thickness regulator including:

a pressing number that is formed from rubber or resin and that extends in a lengthwise direction of the developer bearing body; and a plate spring member that supports the pressing member pressingly against an outer periphery of the developer bearing body to form a thin layer of developer on the developer bearing body, the plate spring member extending in the lengthwise direction of the developer bearing body to a longer length than the pressing member and the pressing member being separated from the lengthwise ends of the plate spring member, thereby leaving end portions of the plate spring member uncovered by the pressing member; and contact members each for slidingly contacting a corresponding peripheral surface of the developer bearing body near a corresponding lengthwise end of the developer bearing body, each contact member being attached to a corresponding one of the end portions of the plate spring and extending to cover the corresponding end portion.

13. A developing device for developing a latent static-electric image into a visible image of developer, the developing device comprising:

a developing case for holding developer, the developing case being formed with an opening;

a developer bearing body supported in the opening at lengthwise ends by the developing case;

a member that vibrates in association with rotation of the developer bearing body;

a case-side seal attached to the developing case, the case-side seal being made from a resilient foam material with a thickness dimension extending in a thickness direction; and a member-side seal made attached to a surface of the member and in abutment with the case-side seal, the member-side seal being made from a resilient foam material with a thickness dimension extending in the thickness direction, the case-side seal and the member-side seal being in a stacked condition in the thickness direction.

14. A developing device as claimed in claim 13, wherein the member is an elongated developer layer thickness regulator disposed with a front surface thereof pressed against an outer periphery of the developer bearing body to form a thin layer of developer on the developer bearing body, the elongated developer layer thickness regulator having a rear surface facing opposite from the front surface, the member-side seal being attached near a lengthwise end of the developer layer thickness regulator on the rear surface of the developer layer thickness regulator.

15. A developing device as claimed in claim 14, wherein:

the developing case is formed with a seal attachment surface and a regulator attachment surface, the developer layer thickness regulator being positioned on the regulator attachment surface to resiliently press the case-side seal and the member-side seal in a thickness direction of the case-side seal and the member-side seal, the seal attachment surface being receded from the regulator attachment surface in the thickness direction by a step portion that extends from the seal attachment surface and that is located adjacent to ends of the developer layer thickness regulator and the member-side seal, and further comprising:

an end seal formed from a resilient foam member and attached to the step portion in contact with the end of the case-side seal.

16. A developing device as claimed in claim 15, wherein the case-side seal is attached to the developing case in pressing contact with the end seal, the end seal having a thickness in a non-compressed condition of 2 mm or less.

17. A developing device as claimed in claim 13, wherein the developer is a polymerized toner prepared using polymerization techniques.

18. A developing device as claimed in claim 13, wherein the developing case 15 a cartridge case adapted for free attachment and detachment with respect to an image forming device that has at least a photosensitive body.

19. A developing device as claimed in claim 13, wherein the developing case is a cartridge case adapted for free attachment and detachment with respect to a process cartridge that has at least a photosensitive body.

20. A process cartridge adapted for free attachment and detachment with respect to an image forming device, the process cartridge comprising:

a photosensitive body formed with a latent static-electric image on its surface; and a developing device for developing the latent static-electric image on the photosensitive body into a visible image of developer, the developing device including:

a developing case for holding developer, the developing case being formed with an opening;

a developer bearing body for transporting developer from the developing case to the photosensitive body, the developer bearing body being supported in the opening at lengthwise ends by the developing case;

a member that vibrates in association with rotation of the developer bearing body;

a case-side seal attached to the developing case, the case-side seal being made from a resilient foam material with a thickness dimension extending in a thickness direction; and a member-side seal attached to a surface of the member and in abutment with the case-side seal, the member-side seal being made from a resilient foam material with a thickness dimension extending in the thickness direction, the case-side seal and the member-side seal being in a stacked condition in the thickness direction.

21. A developing device as claimed in claim 13, wherein the case-side seal and the member-side seal are stacked between the developing case and the member.

22. A developing device as claimed in claim 21, wherein the member vibrates in the thickness direction.

23. A developing device as claimed in claim 20, wherein the case-side seal and the member-side seal are stacked between the developing case and the member.

24. A developing device as claimed in claim 23, wherein the member vibrates in the thickness direction.

* * * * *